US005932963A

United States Patent [19]

Nakamura et al.

[11] Patent Number: 5,932,963

[45] **Date of Patent: *Aug. 3, 1999**

[54] ELECTRON SOURCE AND IMAGE-FORMING APPARATUS WITH A MATRIX ARRAY OF ELECTRON-EMITTING ELEMENTS

[75] Inventors: Naoto Nakamura, Isehara; Hideaki Mitsutake, Yokohama; Yoshihisa Sano; Ichiro Nomura, both of Atsugi; Hidetoshi Suzuki, Fujisawa, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/739,658

[22] Filed: Oct. 31, 1996

Related U.S. Application Data

[63] Continuation of application No. 08/606,237, Feb. 23, 1996, abandoned, which is a continuation of application No. 08/223,214, Apr. 5, 1994, abandoned.

[30] Foreign Application Priority Data

Mar. 29, 1994 [JP] Japan ..... 6-081158

[51] Int. Cl.[6] ..... H01J 31/15

[52] U.S. Cl. ..... 313/495; 313/496; 313/309; 313/336

[58] Field of Search ..... 313/495, 496, 313/306, 307, 309, 336, 351, 355; 315/169.3; 345/74, 75

[56] References Cited

U.S. PATENT DOCUMENTS

| | | | |
|---|---|---|---|
| 4,904,895 | 2/1990 | Tsukamoto et al. | 313/336 |
| 4,908,539 | 3/1990 | Meyer | 315/169.3 |
| 5,066,883 | 11/1991 | Yoshioka et al. | 313/309 |
| 5,185,554 | 2/1993 | Nomura et al. | 313/495 |
| 5,315,206 | 5/1994 | Yoshida | 313/306 |

FOREIGN PATENT DOCUMENTS

| | | |
|---|---|---|
| 0301545 | 2/1989 | European Pat. Off. . |
| 0388984 | 9/1990 | European Pat. Off. . |
| 0523702 | 1/1993 | European Pat. Off. . |
| 64-31332 | 2/1989 | Japan . |
| 320941 | 1/1991 | Japan . |

OTHER PUBLICATIONS

H. Araki, et al., "Electroforming and Electron Emission of Carbon Thin Films", Journal of the Vacuum Society of Japan, vol. 26, No.1, pp. 22–29, (1983).

M. Hartwell, et al., "Strong Electron Emission from Patterned Tin–Indium Oxide Thin Films", International Electron Devices Meeting, pp. 519–521 (1975).

C.A. Mead, "Operation of Tunnel–Emission Devices", Journal of Applied Physics, vol. 32, No. 4, pp. 646–652 (Apr. 1961).

C.A. Spindt, et al., "Physical Properties of Thin–Film Field Emission Cathodes with Molybdenum Cones", Journal of Applied Physics, vol. 47, No. 12, pp. 5248–5263 (Dec. 1976).

M.I. Elinson, et al., "The Emission of Hot Electrons and the Field Emission of Electrons from Tin Oxide", Radio Engineering and Electronic Physics, No. 10, pp. 1290–1295 (Jul. 1965).

W.P. Dyke, et al., "Field Emission", Advances in Electronics and Electron Physics, vol. 8, pp. 89–185 (1956).

G. Dittmer, Electrical Conduction and Electron Emission of Discontinuous Thin Solid Films, 9, pp. 317–328 (1972).

*Primary Examiner*—Sandra L. O'Shea
*Assistant Examiner*—Vip Patel
*Attorney, Agent, or Firm*—Fitzpatrick, Cella, Harper & Scinto

[57] ABSTRACT

An electron source comprises a substrate, a row wire and a column wire disposed on the substrate, and an electron-emitting element connected to both the row and column wires. The electron-emitting region of the electron-emitting element is surrounded by one of both the row and column wires.

43 Claims, 29 Drawing Sheets

TIME

DISPLAY TIMING
1-ST LINE
2-ND LINE
3-RD LINE
4-TH LINE
5-TH LINE
6-TH LINE
WAVEFORM OF APPLIED VOLTAGE

TERMINAL Dx1 7(V)
0(V)

TERMINAL Dx2 7(V)
0(V)

TERMINAL Dx3 7(V)
0(V)

TERMINAL Dx4 7(V)
0(V)

TERMINAL Dx5 7(V)
0(V)

TERMINAL Dx6 7(V)
0(V)
10 μ (S)

TERMINAL Dy1 7(V)
14(V)

TERMINAL Dy2 7(V)
14(V)

TERMINAL Dy3 7(V)
14(V)

TERMINAL Dy4 7(V)
14(V)

TERMINAL Dy5 7(V)
14(V)

TERMINAL Dy6 7(V)

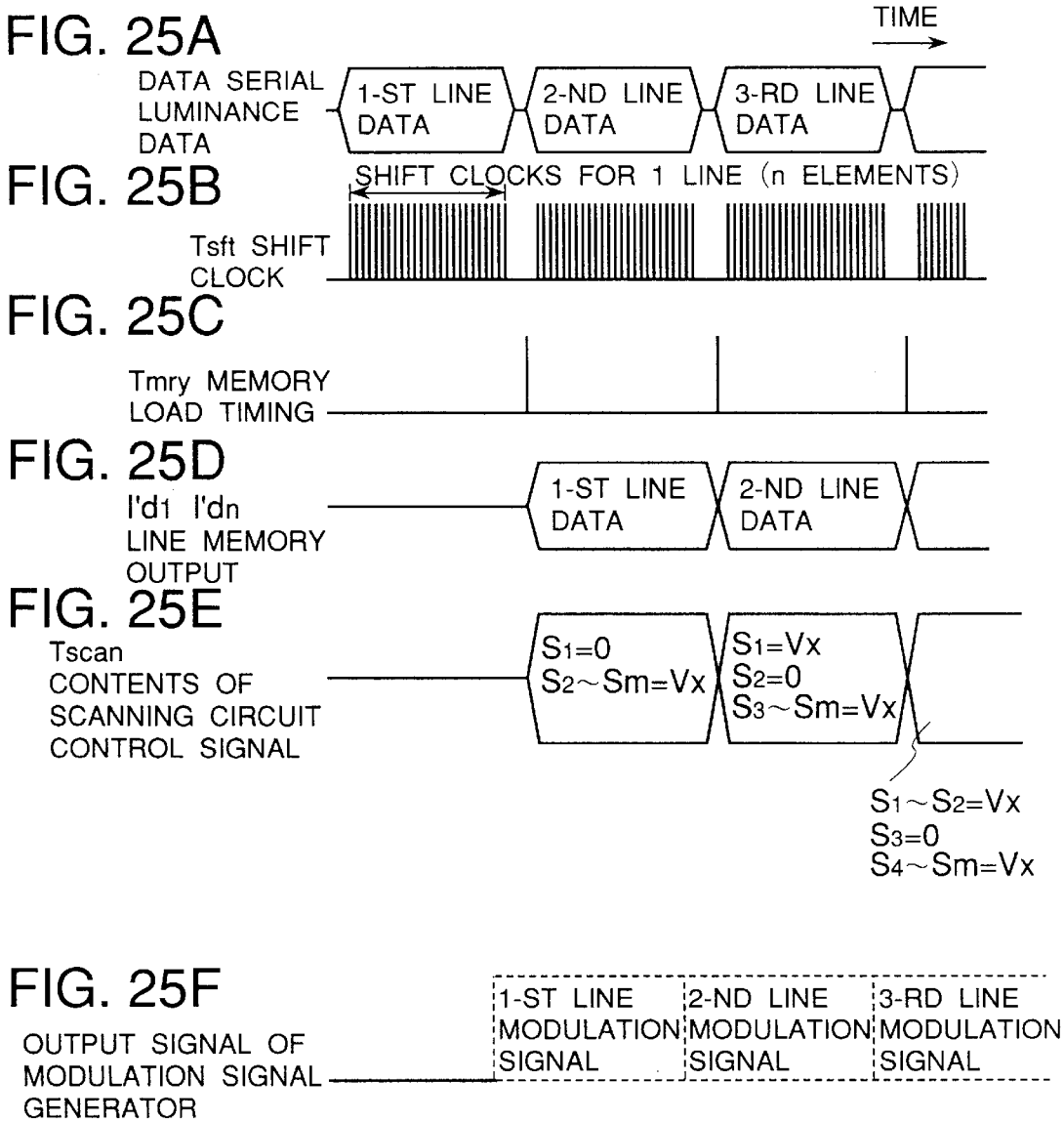
FIG. 25A
TIME
DATA SERIAL LUMINANCE DATA
1-ST LINE DATA
2-ND LINE DATA
3-RD LINE DATA
FIG. 25B
SHIFT CLOCKS FOR 1 LINE (n ELEMENTS)
Tsft SHIFT CLOCK
FIG. 25C
Tmry MEMORY LOAD TIMING
FIG. 25D
I'd1 I'dn LINE MEMORY OUTPUT
1-ST LINE DATA
2-ND LINE DATA
FIG. 25E
Tscan CONTENTS OF SCANNING CIRCUIT CONTROL SIGNAL
S1=0 S2~Sm=Vx
S1=Vx S2=0 S3~Sm=Vx
S1~S2=Vx S3=0 S4~Sm=Vx
FIG. 25F
OUTPUT SIGNAL OF MODULATION SIGNAL GENERATOR
1-ST LINE MODULATION SIGNAL
2-ND LINE MODULATION SIGNAL
3-RD LINE MODULATION SIGNAL

ELECTRON SOURCE AND IMAGE-FORMING APPARATUS WITH A MATRIX ARRAY OF ELECTRON-EMITTING ELEMENTS

This application is a continuation of application Ser. No. 08/606,237, filed Feb. 23, 1996, now abandoned, which is a continuation of application Ser. No. 08/223,214, filed Apr. 5, 1994, now abandoned.

BACKGROUND OF THE INVENTION

1. Field of the Invention

The present invention relates to an electron source and an image-forming apparatus, such as a display device, using the electron source, and more particularly to an electron source comprising a number of surface conduction electron-emitting elements and an image-forming apparatus using the electron source.

2. Related Background Art

Heretofore, two types of electron-emitting elements are known; i.e., a thermal electron source and a cold cathode electron source. Cold cathode electron sources include electron-emitting elements of field emission type (hereinafter abbreviated to FE type), metal/insulating layer/metal type (hereinafter abbreviated to MIM type), and surface conduction type, etc. Examples of FE type elements are described in, e.g., W. P. Dyke & W. W. Dolan, "Field emission", Advance in Electron Physics, 8, 89 (1956) and C. A. Spindt, "PHYSICAL Properties of thin-film field emission cathodes with molybednum cones", J. Appl. Phys., 47, 5248 (1976).

One example of MIM type elements is described in, e.g., C. A. Mead, "The tunnel-emission amplifier", J. Appl. Phys., 32, 646 (1961).

One example of surface conduction electron-emitting elements is described in, e.g., M. I. Elinson, Radio Eng. Electron Phys., 10, (1965).

A surface conduction electron-emitting element utilizes a phenomenon that when a thin film having a small area is formed on a substrate and a current is supplied to flow parallel to the film surface, electrons are emitted therefrom. As to such a surface conduction electron-emitting element, there have been reported, for example, one using a thin film of $SnO_2$ by Elinson as cited above, one using an Au thin film [G. Dittmer: "Thin Solid Films", 9, 317 (1972)], one using a thin film of $In_2O_3/SnO_2$ [M. Hartwell and C. G. Fonstad: "IEEE Trans. ED Conf.", 519 (1975)], and one using a carbon film [Hisashi Araki et. al.: "Vacuum", Vol. 26, No. 1, p. 22 (1983)].

As a typical configuration of those surface conduction electron-emitting elements, FIG. 19 shows the element configuration proposed by M. Hartwell in the above-cited paper. In FIG. 19, denoted by reference numeral 101 is an insulating substrate. 102 is a thin film for forming an electron-emitting region which comprises, e.g., a metal oxide thin film formed by sputtering into an H-shaped pattern. An electron-emitting region 103 is formed by the energizing process called forming (described later). 104 is a thin film including the electron-emitting region 103. The dimensions indicated by L1 and W in the figure are set to 0.5–1 mm and 0.1 mm, respectively.

In those surface conduction electron-emitting elements, it has heretofore been general that the electron-emitting region forming thin film 102 is subjected to the energizing process called forming in advance to form the electron-emitting region 103 before starting emission of electrons. The term "forming" means the process of applying a voltage across the electron-emitting region forming thin film 102 to locally destroy, deform or denature it to thereby form the electron-emitting region 103 which has been transformed into an electrically high-resistance state. The electron-emitting region 103 emits electrons from the vicinity of a crack generated in a portion of the electron-emitting region forming thin film 102. The electron-emitting region forming thin film 102 including the electron-emitting region 103 which has been formed by the forming process will be referred to here as the electron-emitting region including thin film 104. In the surface conduction electron-emitting element after the forming process, a voltage is applied to the electron-emitting region including thin film 104 to supply the element with a current, whereupon electrons are emitted from the electron-emitting region 103.

The above surface conduction electron-emitting element is simple in structure and easy to manufacture, and hence has an advantage that a number of elements can be formed into an array having a large area. Therefore, various applications making use of such an advantage have been studied. Examples of the applications are a charged beam source and a display device. As an example in which a number of surface conduction electron-emitting elements are formed into an array, there is proposed an electron source that surface conduction electron-emitting elements are arranged in parallel, ends of the elements are interconnected by respective leads for each of opposite sides to form one row of an array, and a number of rows are arranged to form the array (See, e.g., Japanese Patent Application Laid-Open No. 64-31332 by the applicant). In the field of image display devices or the like, particularly, flat display devices using liquid crystals have recently become popular instead of CRTs, but they are not self-luminous and have a problem of requiring backlights. Development of self-luminous display devices have therefore been desired.

An image display device in which an electron source having an array of numerous surface conduction electron-emitting elements and a fluorescent substance radiating visible light upon impingement of electrons emitted from the electron source are combined with each other to form a display device, is a self-luminous display device which is relatively easy to manufacture and has good display quality while providing a large screen size (See, e.g., U.S. Pat. No. 5,066,883 by the applicant).

In the above self-luminous display device with an electron source using surface conduction electron-emitting elements, a desired one of the numerous surface conduction electron-emitting elements making up the electron source, which is to emit electrons for radiating light from the fluorescent substance, is selected by combination of a linear electron source (referred to as a row-direction electron source) comprising the numerous surface conduction electron-emitting elements which are arranged in parallel to lie in the row direction (or called X-direction) and interconnected by leads, and a drive signal applied to corresponding one of control electrodes (called grids), which are disposed in spaces between the electron source and the fluorescent substance, in a direction (called column direction or Y-direction) perpendicular to the row-direction electron source (See, e.g., Japanese Patent Application Laid-Open No. 64-31332 by the applicant).

In that image display device, it is naturally required to produce a good image with less variations in specific properties such as brightness that not only horizontal alignment between the individual surface conduction electron-emitting elements and the corresponding grids, but also vertical distances between the grids and the surface conduction electron-emitting elements are uniform. Therefore, the applicant has proposed a novel structure that grids are laminated over surface conduction electron-emitting elements, which is effective to align the grids and the surface conduction electron-emitting elements with high accuracy (See, e.g., Japanese Patent Application Laid-Open No. 3-20941 by the applicant).

In a conventional electron source having grids and an image display device having such an electron source, it is generally possible to control convergence and divergence of electron beams by properly controlling a voltage applied to the grids.

In the image display device, proposed by the applicant, wherein numerous surface conduction electron-emitting elements are arrayed to form an electron source and a fluorescent substance is disposed in opposite relation to the electron source, grids disposed to lie in a direction (column direction) perpendicular to leads (row-direction leads) for the elements arranged in parallel have also been indispensable to select the desired element for emitting electrons.

Further, in order that the fluorescent substance disposed in opposite relation to the electron source radiates light with brightness selectively controlled, the grids disposed to lie in the direction perpendicular to the row-direction leads for the elements have also been indispensable.

SUMMARY OF THE INVENTION

An object of the present invention is to provide an electron source comprising numerous elements which can select any desired one of the numerous source elements and control an amount of electrons emitted therefrom with a simpler structure and more easiness than the conventional electron sources having grids, and an image-forming apparatus such as an image display device comprising such an electron source and a fluorescent substance disposed in opposite relation to the electron source, which can make the fluorescent substance radiate light with brightness selectively controlled and higher image quality than the image display devices using the conventional electron sources.

Another object of the present invention is to provide an electron source and an image-forming apparatus such as an image display device using the electron source, which can improve convergence of an emitted electron beam with a simpler structure and more easiness than the conventional electron sources having grids and the image display devices using the conventional electron sources.

To achieve the above objects, according to the present invention, there is provided an electron source comprising a substrate, a row wire and a column wire disposed on the substrate, and an electron-emitting element connected to both the row and column wires, wherein the electron-emitting region of the electron-emitting element is surrounded by one of both the row and column wires.

In the above electron source, preferably, the electron-emitting region of the electron-emitting element is surrounded by the wire, in at least three of four directions orthogonal to each other in the plane in which the electron-emitting element is disposed.

In the above electron source, preferably, the magnitude of a potential applied to the wire surrounding the electron-emitting region is not greater than that of a potential applied to the other wire.

Also in the above electron source, preferably, to the wire surrounding the electron-emitting region is applied a potential corresponding to a scanning signal, while to the other wire is applied a potential corresponding to a modulation signal.

Further, preferably in the above electron source, the electron-emitting element, the row wire and the column wire are each provided plural in number, the plurality of electron-emitting elements being arrayed into a matrix pattern, and the electron-emitting region of each of the plurality of electron-emitting elements is surrounded by one of both the row and column wires.

In the above electron source, preferably, the electron-emitting region of each of the electron-emitting elements is surrounded by the wire in at least three of four directions orthogonal to each other in the plane in which the electron-emitting element is disposed.

To achieve the above objects, according to the present invention, there is also provided an electron source comprising a substrate, a row wire and a column wire laminated on the substrate to cross each other with an insulating layer interposed therebetween, and an electron-emitting element connected to both the row and column wires, wherein the electron-emitting region of the electron-emitting element is surrounded by one of both the row and column wires which is disposed over the insulating layer.

In the above electron source, preferably, the electron-emitting region of the electron-emitting element is surrounded by the wire which is disposed over the insulating layer, in at least three of four directions orthogonal to each other in the plane in which the electron-emitting element is disposed.

In the above electron source, preferably, the wire disposed over the insulating layer is a wire to which a potential corresponding to a scanning signal is applied.

In the above electron source, preferably, the magnitude of the potential corresponding to the scanning signal is not greater than that of a potential applied to the other of the wires which is disposed under the insulating layer.

Further, preferably in the above electron source, the electron-emitting element, the row wire and the column wire are each provided plural in number, the plurality of electron-emitting elements being arrayed into a matrix pattern, and the electron-emitting region of each of the plurality of electron-emitting elements is surrounded by one of both the row and column wires which is disposed over the insulating layer.

In the above electron source, preferably, the electron-emitting region of each of the electron-emitting elements is surrounded by the wire which is disposed over the insulating layer, in at least three of four directions orthogonal to each other in the plane in which the electron-emitting element is disposed.

In the above electron source, preferably, the lead disposed over the insulating layer is a wire to which a potential corresponding to a scanning signal is applied.

In the above electron source, preferably, the magnitude of the potential corresponding to the scanning signal is not greater than that of a potential applied to the other of the wires which is disposed under the insulating layer.

In the above electron source, preferably, the potential applied the wire disposed under the insulating layer is a potential corresponding to a modulation signal.

In the above electron source, preferably, the magnitude of the potential corresponding to the scanning signal is not greater than that of the potential corresponding to the modulation signal.

To achieve the above objects, according to the present invention, there is further provided an image-forming apparatus using any one of the electron sources described above.

BRIEF DESCRIPTION OF THE DRAWINGS

FIGS. 25A to 25F are timing charts for operation of the entire image-forming apparatus shown in FIG. 20.

DETAILED DESCRIPTION OF THE PREFERRED EMBODIMENTS

Preferred embodiments of the present invention will hereinafter be described in detail.

A description will first be made of the basic structure, manufacture process and characteristics of an element according to the present invention (with reference to, e.g., Japanese Patent Application Laid-Open Nos. 2-56822 and 4-28139), as well as characteristics as the basis for the principle of the present invention discovered by the inventors as the result of intensive studies.

Figure 19:
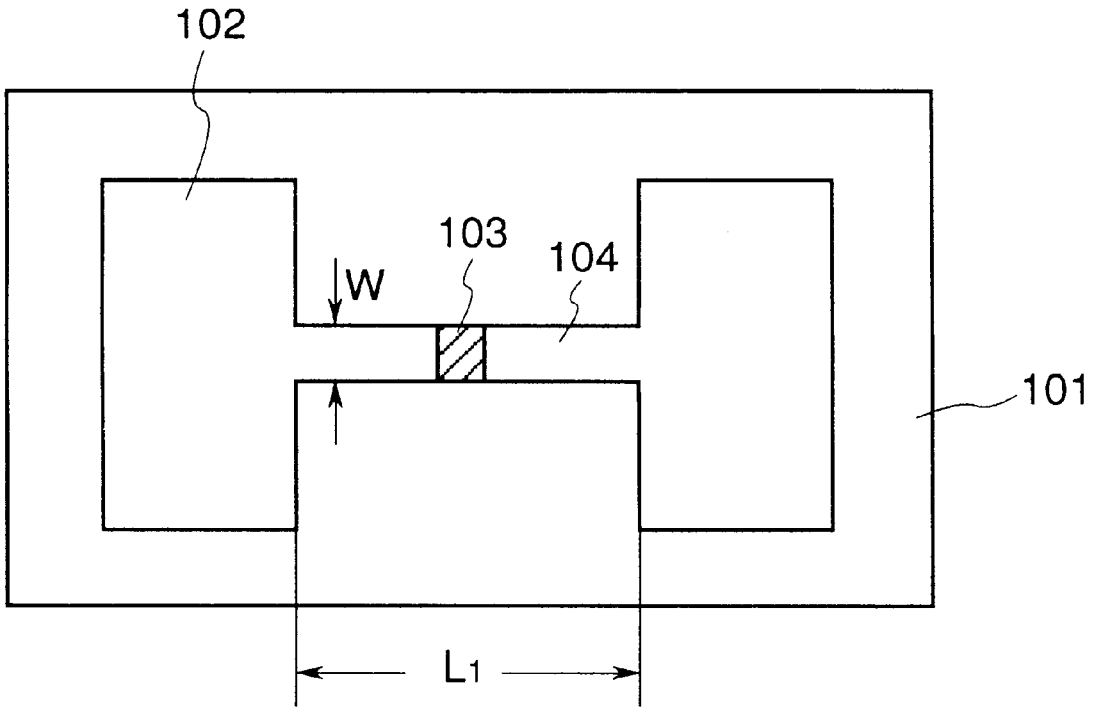
FIG. 19 is a plan view of a conventional planar type surface conduction electron-emitting element.

Taking FIG. 19 as a reference example, features of the structure and manufacture process of a surface conduction electron-emitting element according to the present invention are as follows:

1) The electron-emitting region forming thin film 102 prior to the energizing process called forming is basically made up of fine particles, i.e., it is a thin film made up of fine particles which is formed by dispersing a disperse system of fine particles, or a thin film made up of fine particle which is formed by heating and baking an organic metal or the like; and 2) The electron-emitting region including thin film 104 after the energizing process called forming is basically made up of fine particles along with the electron-emitting region 103.

The basic structure of a surface conduction electron-emitting element is divided into planar type and vertical type.

A planar type surface conduction electron-emitting element will first be described.

Figure 12A:
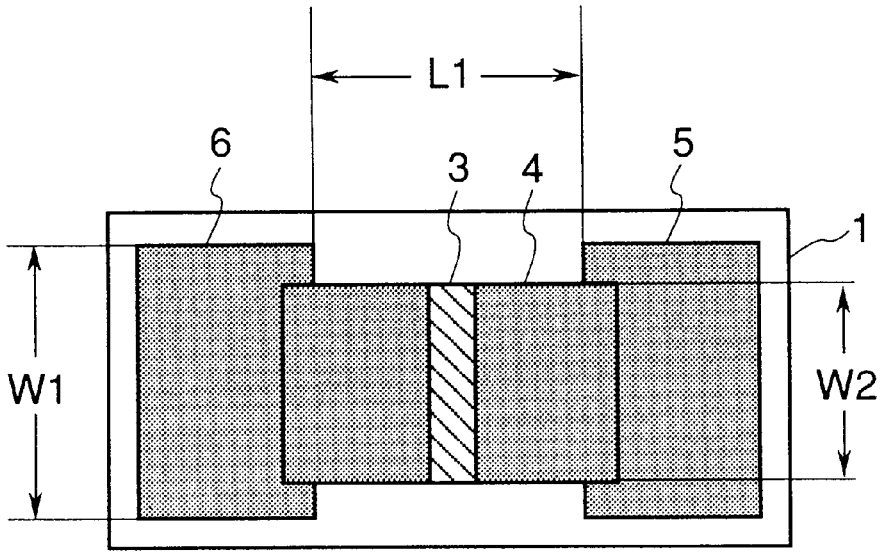
FIGS. 12A and 12B are a plan view and a sectional view, respectively, of the basic structure of a planar type surface conduction electron-emitting element.
Figure 12B:
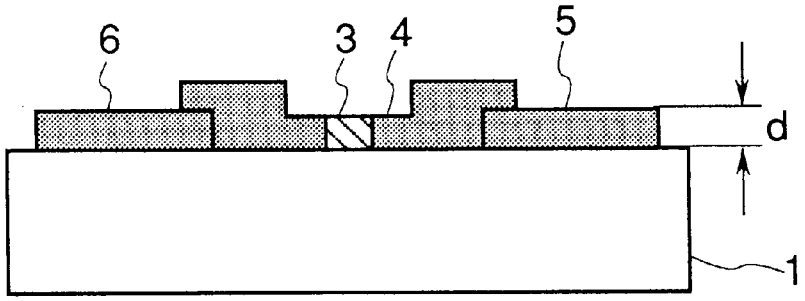

FIGS. 12A and 12B are a plan view and a sectional view, respectively, of the basic structure of a planar type surface conduction electron-emitting element. The basic structure of the element will be described with reference to FIGS. 12A and 12B.

In FIGS. 12A and 12B, denoted by reference numeral 1 is an insulating substrate, 5 and 6 are element electrodes, and 4 is an electron-emitting region including thin film in which an electron-emitting region 3 is formed by subjecting an electron-emitting region forming thin film to the forming process.

The insulating substrate 1 may be of, for example, a glass substrate made of, e.g., quartz glass, glass having a reduced content of impurities such as Na, soda lime glass and soda lime glass having $SiO_2$ laminated thereon by sputtering, or a ceramic substrate made of, e.g., alumina.

The element electrodes 5, 6 arranged in opposite relation may be made of any material which has conductivity. Examples of electrode materials are metals such as Ni, Cr, Au, Mo, W, Pt, Ti, Al, Cu and Pd or alloys thereof, printing conductors comprising metals such as Pd, Ag, Au, $RuO_2$ and Pd-Ag or oxides thereof, glass, etc., transparent conductors such as $In_2O_3$-$SnO_2O$ and semiconductors such as polysilicon. The distance L1 between the element electrodes is in the range of several hundred angstroms to several hundred microns, and is set depending on the photolithography technique as the basis for a manufacture process of the element electrodes, i.e., performance of an exposure machine and an etching method, and element factors such as the voltage applied between the element electrodes and the intensity of an electric field capable of emitting electrons. Preferably, the distance L1 is in the range of several microns to several hundreds microns. The length W1 and the film thickness d of the element electrodes 5, 6 are properly set in consideration of the resistance values of the electrodes, connection to lead electrodes in the X- and Y-directions, the problem in the arrangement of numerous elements making up an entire electron source, etc. The length W1 of the element electrodes is usually in the range of several microns to several hundreds microns, and the film thickness d of the element electrodes is preferably in the range of several hundreds angstroms to several microns.

The electron-emitting region including thin film 4 is positioned so as to cover the region between the element electrodes 5, 6 disposed on the insulating substrate 1. The electron-emitting region including thin film 4 is not limited to the configuration shown in FIG. 12B, and may not be positioned over both the element electrodes 5, 6. This case results when the electron-emitting region forming thin film and the opposite element electrodes 5, 6 are laminated on the insulating substrate 1 in this order. Alternatively, the entire region between the opposite element electrodes 5, 6 may function as the electron-emitting region depending on the manufacture process. The electron-emitting region including thin film 4 has a thickness in the range of several angstroms to several thousands angstroms, preferably several angstroms to several hundreds angstroms. The film thickness is properly set in consideration of the step coverage over the element electrodes 5, 6, the resistance value between the electron-emitting region 3 and the element electrodes 5, 6, the particle diameter of conductive fine particles in the electron-emitting region 3, conditions of the energizing process (described later), etc. The electron-emitting region including thin film 4 has a sheet resistance value of $10^3$ to $10^7$ ohms/□. Specific examples of materials of the electron-emitting region including thin film 4 are metals such as Pd, Ru, Ag, Au, Ti, In, Cu, Cr, Fe, Zn, Sn, Ta, W and Pb, oxides such as PdO, $SnO_2$, $In_2O_3$, PbO, $Sb_2O_3$, borides such as $HfB_2$, $ZrB_2$, $LaB_6$, $CeB_6$, $YB_4$ and $GdB_4$, carbides such as TiC, ZrC, HfC, TaC, SiC and WC, nitrides such as TiN, ZrN and HfN, semiconductors such as Si and Ge, carbon, AgMg, NiCu, Pb, and Sn. In any case, the thin film 4 is a fine particle film.

The term "fine particle film" used herein means a film comprising a number of fine particles aggregated together, and includes films having micro structures in which fine particles are not only individually dispersed, but also adjacent to or overlapped with each other (including an island state).

The electron-emitting region 3 is made up of a number of conductive fine particles having the particle diameter in the range of several angstroms to several thousands angstroms, preferably 10 angstroms to 200 angstroms. The thickness of the electron-emitting region 3 depends on the thickness of the electron-emitting region including thin film 4, the manufacture process such as conditions of the energizing process (described later), etc., and is set in an appropriate range. Materials of the electron-emitting region 3 are the same as a part or all of the materials of the electron-emitting region including thin film 4 for respective constituent elements of the latter.

Figure 13A:
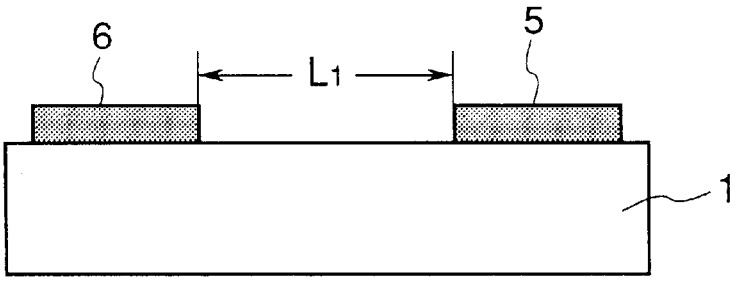
FIGS. 13A through 13C are sectional views of the basic structure of the planar type surface conduction electron-emitting element.
Figure 13B:
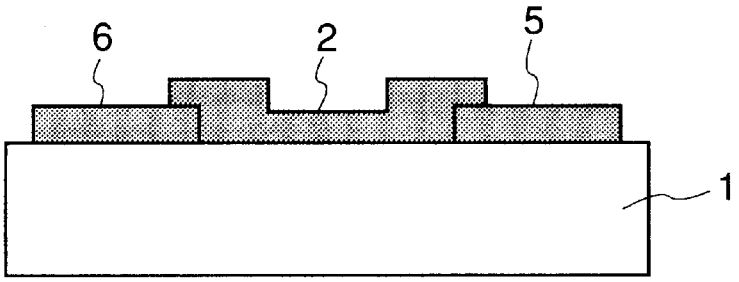
Figure 13C:
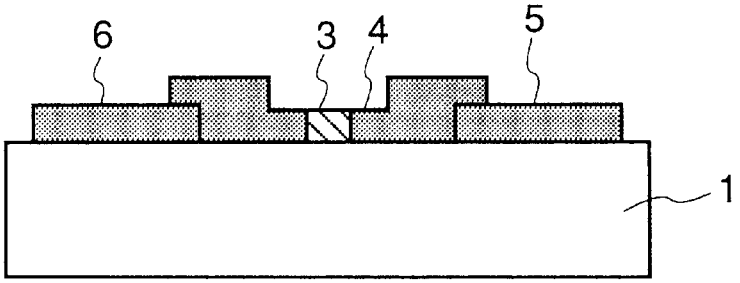

While the electron-emitting element having the electron-emitting region 3 can be manufactured by various methods, one typical example is shown in FIGS. 13A to 13C.

The electron-emitting region forming thin film 2 may be of, e.g., a fine particle film.

The manufacture process will be described below in the order of successive steps with reference to FIGS. 12A to 13C.

1) The insulating substrate 1 is sufficiently washed with a detergent, pure water and an organic solvent. An element electrode material is then deposited on the insulating substrate 1 by vacuum evaporation, sputtering or other suitable method. The element electrodes 5, 6 are then formed on the surface of the insulating substrate 1 by the photolithography technique (FIG. 13A).

2) Between the element electrodes 5, 6 provided on the insulating substrate 1, an organic metal thin film is formed by coating an organic metal solution over the insulating substrate 1 between the element electrodes 5, 6 and then leaving the coating to stand as it is. The organic metal solution is a solution of an organic compound containing, as a primary element, any of the above-cited metals such as Pd, Ru, Ag, Au, Ti, In, Cu, Cr. Fe, Zn, Sn, Ta, W and Pb. After that, the organic metal thin film is heated for baking and patterned by lift-off or etching to thereby form the electron-emitting region forming thin film 2 (FIG. 13B). While the organic metal thin film is formed by coating the organic metal solution in the above, it is not limited to the coating in forming method, but may be formed by other methods such as vacuum evaporation, sputtering, chemical vapor-phase deposition, dispersion coating, dipping and spinning.

3) Subsequently, the energizing process called forming is carried out by applying a pulse-like voltage or a rapidly boosting voltage between the element electrode 5 and 6 from a power supply (not shown). The electron-emitting region forming thin film 2 is thereby locally changed in its structure so as to form the electron-emitting region 3 (FIG. 13C). A portion of the electron-emitting region forming thin film 2 where the structure is locally destroyed, deformed or denatured by the energizing process will be referred to as the electron-emitting region 3. As previously described, the inventors have found by observing the electron-emitting region 3 that the region 3 is made up of conductive fine particles.. The voltage waveform for the forming process is shown in FIG. 14.

Figure 14:
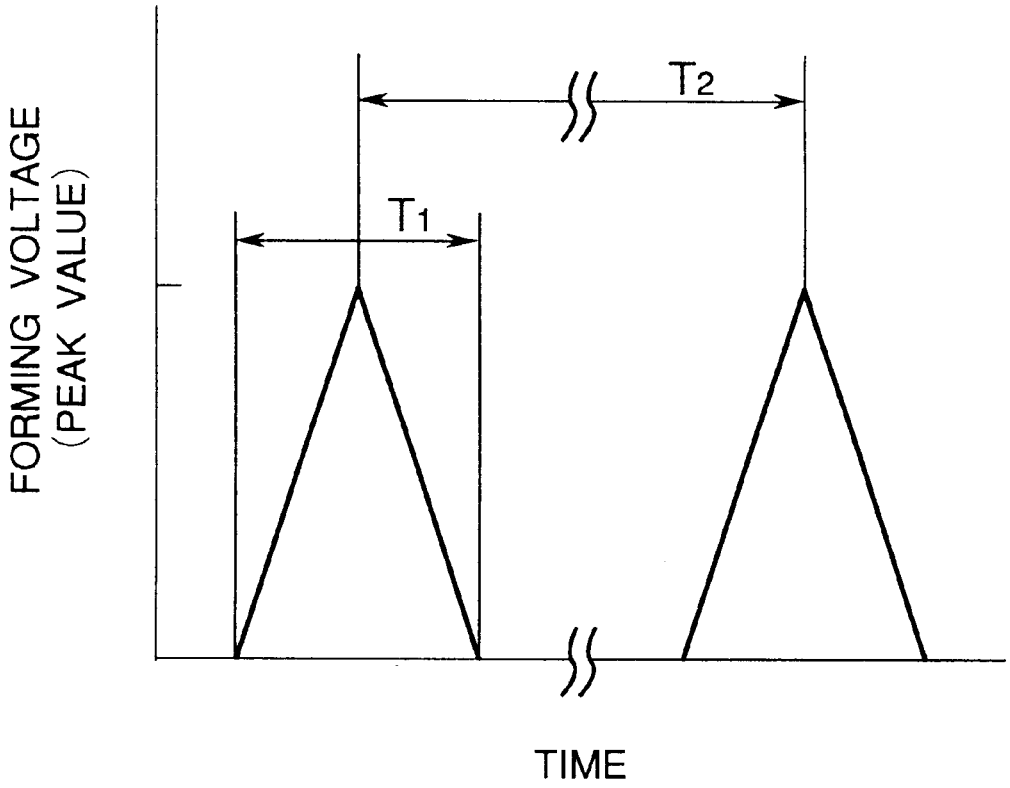
FIG. 14 is a chart showing a voltage waveform for use in the energizing process for a surface conduction electron-emitting element.

In FIG. 14, T1 and T2 indicate a pulse width and interval of the voltage waveform, and are set to the range of 1 microsecond to 10 milliseconds and 10 microseconds to 100 milliseconds, respectively. The crest value of the triangular wave (i.e., the peak value during the forming) is in the range of 4 V to 10 V. The forming process is performed under vacuum atmosphere for about several tens seconds.

When forming the electron-emitting region, the triangular pulse is applied between the element electrodes to carry out the forming process in the above. However, the waveform applied between the element electrodes is not limited to the triangular waveform, but may be any other desired one such as rectangular waveform. The crest value, the pulse width and interval, etc. are also not limited to the above values, but may be set to any other desired values with which the electron-emitting region can be formed satisfactorily.

Basic characteristics of the electron-emitting element fabricated in accordance with the above-described element structure and manufacturing process will now be described with reference to FIGS. 15 and 16.

Figure 15:
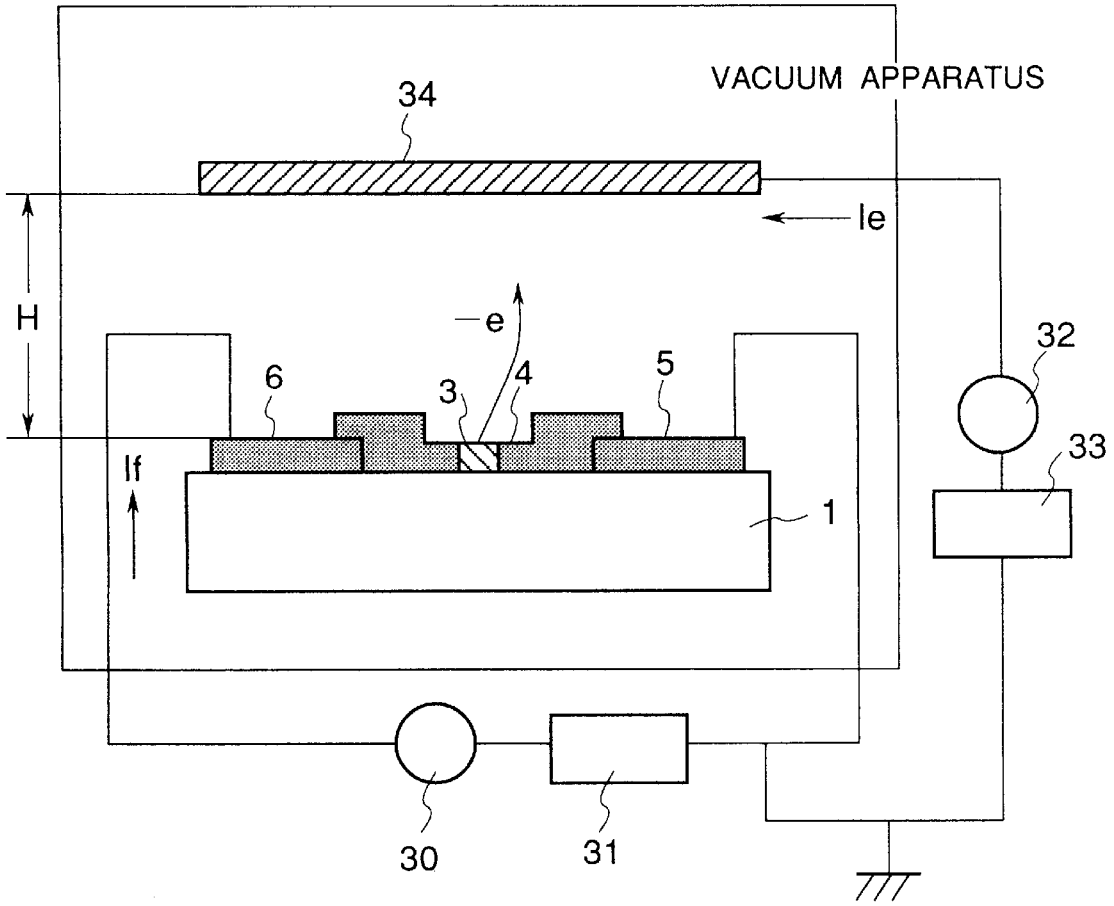
FIG. 15 is a diagram of a basic measuring and evaluating device for the surface conduction electron-emitting element.

FIG. 15 is a diagram of a device for measuring and evaluating an electron emission characteristic of the element shown in FIGS. 12A and 12B. In FIG. 15, denoted by 1 is the insulating substrate, 5 and 6 are the element electrodes, 4 is the electron-emitting region including thin film, and 3 is the electron-emitting region. Further, 31 is a power supply for applying an element voltage Vf to the element, 30 is an ammeter for measuring an element current If flowing through the electron-emitting region including thin film 4 between the electrodes 5 and 6, 34 is an anode electrode for capturing an emission current Ie from the electron-emitting region 3 of the element, 33 is a high-voltage power supply for applying a voltage to the anode electrode 34, and 32 is an ammeter for measuring the emission current Ie from the electron-emitting region 3 of the element.

For measuring the element current If and the emission current Ie of the electron-emitting element, the power supply 31 and the ammeter 30 are connected to the element electrodes 5, 6, and the anode electrode 34 connected to the power supply 33 and the ammeter 32 is disposed above the electron-emitting element. The electron-emitting element and the anode electrode 34 are disposed in a vacuum apparatus which is provided with additional necessary units such as an evacuation pump and a vacuum gauge, so that the element is measured and evaluated under a desired vacuum.

The voltage applied to the anode electrode is set in the range of 1 kV to 10 kV, and the distance H between the anode electrode and the electron-emitting element is set in the range of 3 mm to 8 mm.

As a result of intensively studying characteristics of the surface conduction electron-emitting element, the inventors have found specific features in characteristics providing the principle with which the element can be selected and controlled as desired without grids. A typical example of the relationship among the emission current Ie, the element current If and the element voltage Vf measured by using the measuring and evaluating device of FIG. 15 is shown in FIG. 16. Note that the graph of FIG. 16 is plotted in arbitrary units because the magnitudes of If, Ie are greately different from each other.

Figure 16:
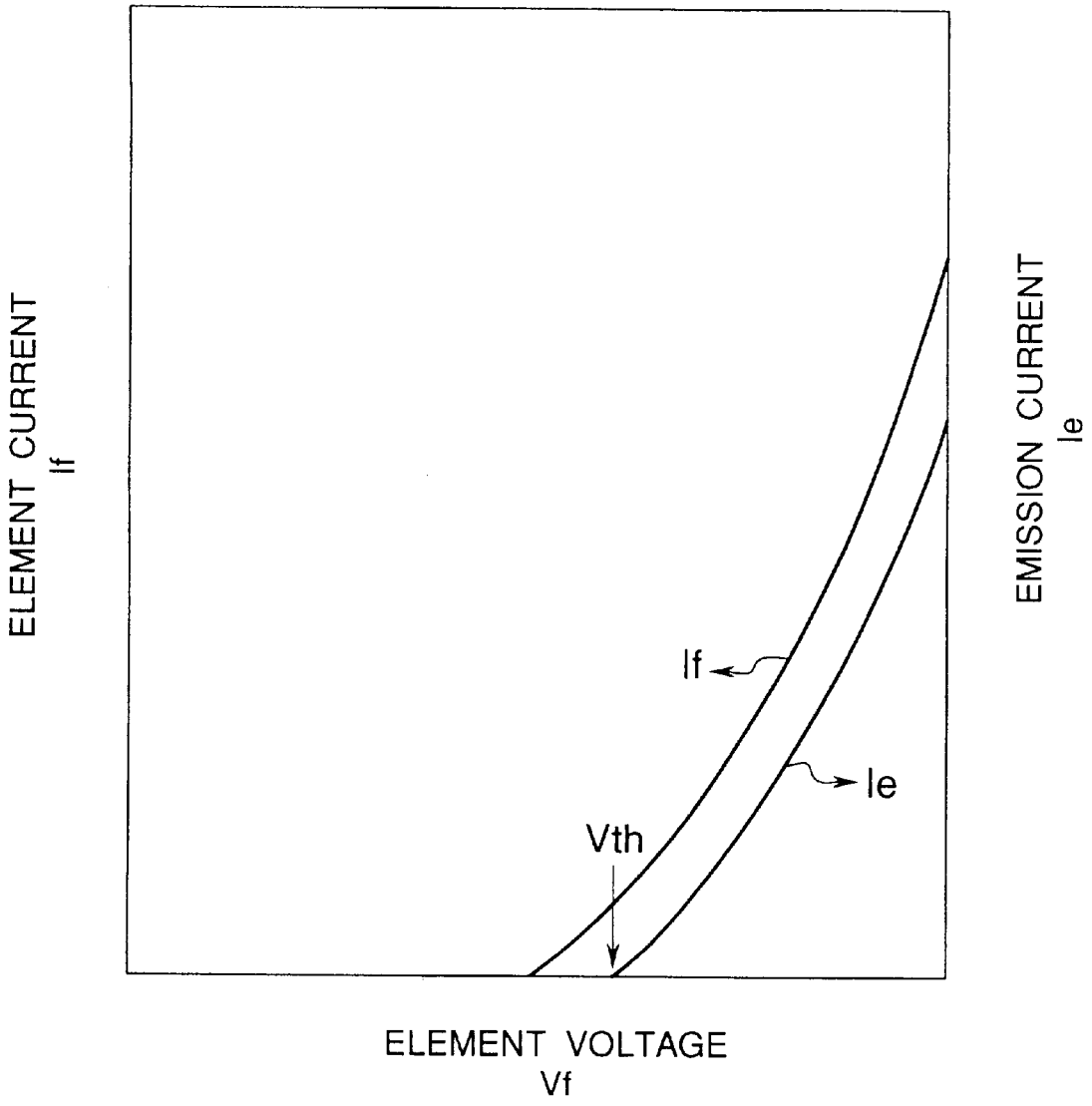
FIG. 16 is a graph showing basic characteristics of the surface conduction electron-emitting element.

As will be apparent from FIG. 16, the present electron-emitting element has three characteristics for the emission current Ie.

First, the emission current Ie is abruptly increased when the element voltage greater than a certain value (called a threshold voltage, Vth in FIG. 5), but it is not appreciably detected below the threshold voltage Vth. Thus, the present element is a non-linear element having the definite threshold voltage Vth with respect to the emission current Ie.

Secondly, the emission current Ie depends on the element voltage Vf and, therefore, the emission current Ie can be controlled by the element voltage Vf.

Thirdly, emitted charges captured by the anode electrode 34 depends on the time during which the element voltage Vf is applied. Thus, the amount of the charges captured by the anode electrode 34 can be controlled with the time during which the element voltage Vf is applied.

FIG. 16 shows an example of the characteristic (called MI characteristic) that the element current If increases monotonously with respect to the element voltage Vf. In addition, the element current If may exhibit a voltage controlled negative resistance (VCNR) characteristic with respect to the element voltage Vf. In this case, the present electron-emitting element has the above three specific features in characteristics.

Figure 17:
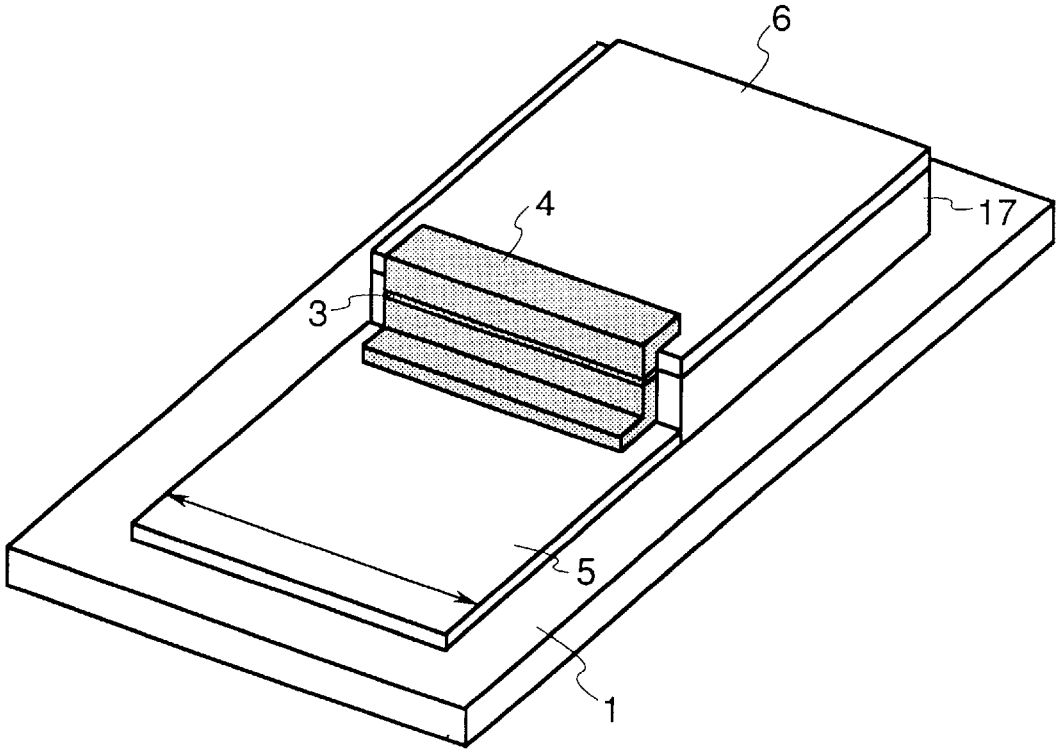
FIG. 17 is a perspective view of the basic structure of a vertical type surface conduction electron-emitting element.

A description will now be made of a vertical type surface conduction electron-emitting element as the surface conduction electron-emitting element having another structure. FIG. 17 shows the basic structure of a vertical type surface conduction electron-emitting element according to the present invention.

In FIG. 17, denoted by 1 is an insulating substrate, 5 and 6 are element electrodes, 4 is an electron-emitting region including thin film, 3 is an electron-emitting region, and 17 is a step-forming section. It is preferable that the position of the electron-emitting region 3 is not changed depending on the thickness and manufacture process of the step-forming section 17 and the thickness and manufacture process of the electron-emitting region including thin film 4.

As the insulating substrate 1, the element electrodes 5, 6, the electron-emitting region including thin film 4 and the electron-emitting region 3 are each made of the same materials as used for the planar type surface conduction electron-emitting elements described above, the step-forming section 17 and the electron-emitting region including thin film 4 which are factors characterizing the vertical type surface conduction electron-emitting element will be described in detail. The step-forming section 17 is formed of an insulating material such as $SiO_2$ by vacuum evaporation, printing, sputtering or the like. The thickness of the step-forming section 17 corresponds to the distance L1 between the element electrodes of the planar type surface conduction electron-emitting element described above. Depending on the manufacture process of the step-forming section, the voltage applied between the element electrodes, and the intensity of an electric field capable of emitting electrons, the thickness of the step-forming section 17 is usually set in the range of several hundred angstroms to several hundred microns, preferably 1000 angstroms to 10 microns.

Since the electron-emitting region including thin film 4 is formed after fabricating the element electrodes 5, 6 and the step-forming section 17, the thin film 4 is laminated on the element electrodes 5, 6 and, in some cases, it may be formed into any desired shape except for portions thereof which are overlapped with the element electrodes 5, 6 for electrical connection thereto. The thickness of the electron-emitting region including thin film 4 is different between its portion on the step-forming section 17 and its portions on the element electrodes 5, 6 in many cases depending the manufacture process. Generally, the film thickness on the step-forming section is smaller than that on the element electrodes 5, 6. As a result, the vertical type surface conduction electron-emitting element is more easily subjected to the energizing process and hence the formation of the electron-emitting region 3 in many cases as compared with the planar type surface conduction electron-emitting element described above.

While the basic structures and manufacture processes of the surface conduction electron-emitting elements have been described above, the invention is not limited to the above embodiments, and any other surface conduction electron-emitting elements which have the above-described three specific features in their characteristics are also applicable to electron sources and image display devices (described later).

According to the three specific features in basic characteristics of the surface conduction electron-emitting element according to the present invention, as previously stated, the electrons emitted from the surface conduction electron-emitting element is controlled depending on the crest value and width of the pulse-like voltage applied to the opposite element electrodes when the applied voltage is higher than the threshold value. On the other hand, no electrons are emitted at the voltage lower than the threshold value. Based on these characteristics, even when a number of electron-emitting elements are arranged into an array, it is possible to select any desired one of the surface conduction electron-emitting elements and to control the amount of electrons emitted therefrom by properly applying the pulse-like voltage to each corresponding element. The structure of an electron source substrate fabricated in accordance with the above principle will be described below with reference to FIG. 18.

Denoted by 71 is an insulating substrate, 72 is an X-direction wire (electrode), 73 is a Y-direction wire (electrode), 74 is a surface conduction electron-emitting element, and 75 a connecting electrode (or wire). The surface conduction electron-emitting element 74 may be of either the planar or vertical type.

Figure 18:
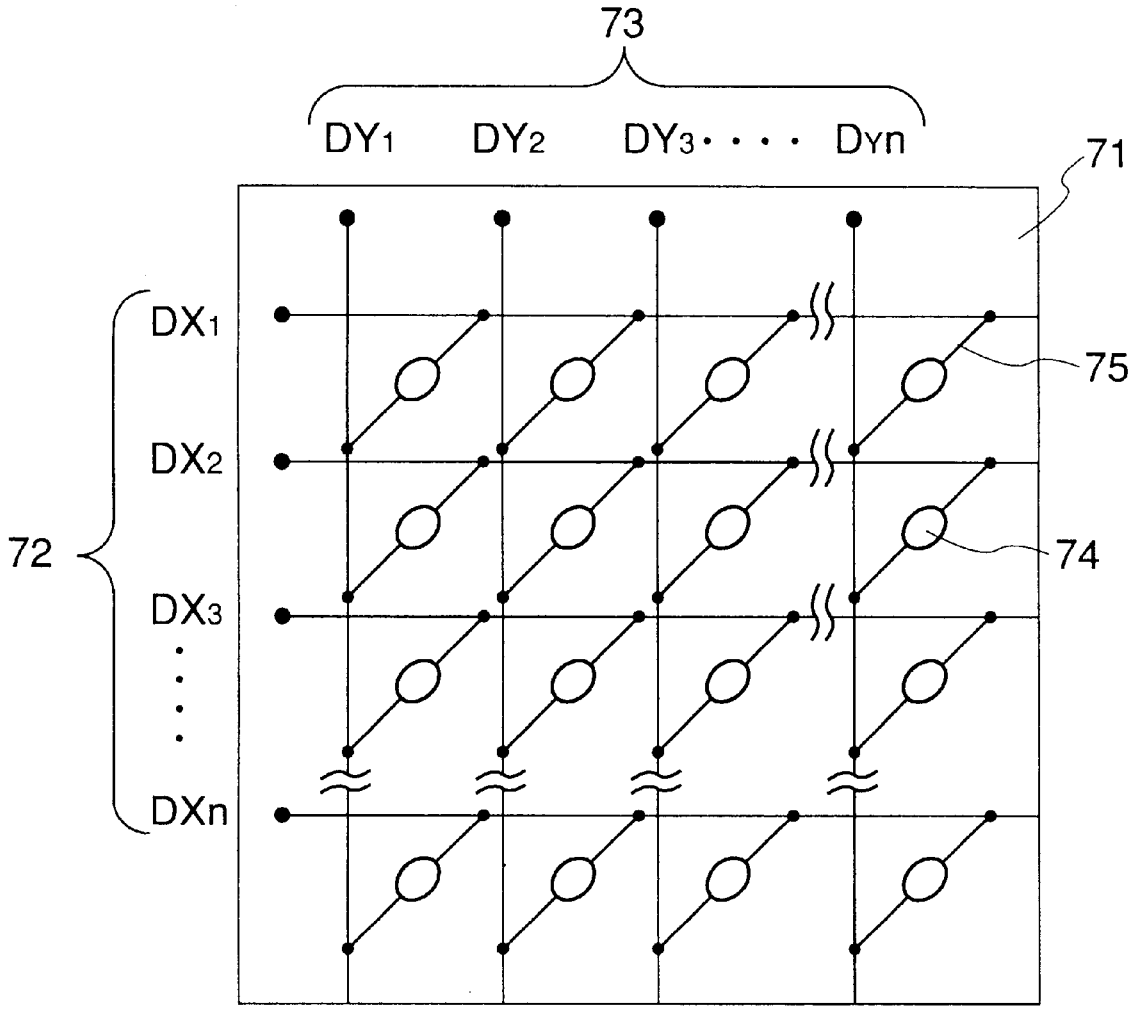
FIG. 18 is a diagram showing the arrangement of an electron source comprising numerous surface conduction electron-emitting elements arrayed into a matrix pattern.

In FIG. 18, the insulating substrate 71 is of a glass substrate or the like as previously described, and its size and thickness are properly set in consideration of the number of surface conduction electron-emitting elements, the shape of each element in design, and conditions for keeping a vacuum in an envelope when the envelope is partly formed of the insulating substrate 71 during use of the electron source. Then, m lines of X-direction wire 72, indicated by DX1, DX2, . . . , DXm, are made of thin films of a conductive metal or the like which are formed on the insulating substrate 71 by vacuum evaporation, printing, sputtering or the like and then patterned into a desired wiring configuration. The material, film thickness and width of the X-direction wire 72 are set so that a voltage as uniform as possible is supplied to all of the numerous surface conduction electron-emitting elements. Also, n lines of Y-direction wire 73, indicated by DY1, DY2, . . . , DYn, are made of thin films of a conductive metal or the like which are formed on the insulating substrate 71 by vacuum evaporation, printing, sputtering or the like and then patterned into a desired wiring configuration, as with the X-direction wire 72. The material, film thickness and width of the Y-direction wire 73 are set so that a voltage as uniform as possible is supplied to all of the numerous surface conduction electron-emitting elements. An interlayer insulating layer (not shown) is interposed between the m lines of X-direction wire 72 and the n lines of Y-direction wire 73 to electrically isolate them from each other, thereby making up a matrix wiring. (Note that m, n are each a positive integer). The not-shown interlayer insulating layer is made of a thin film of $SiO_2$ or the like which is formed by vacuum evaporation, printing, sputtering or the like into a desired shape so as to cover the entire or partial surface of the insulating substrate 71 on which the X-direction wire 72 has been formed. The X-direction wire 72 and the Y-direction wire 73 are led out to provide external terminals.

Further, a pair of opposite element electrodes (not shown) of each of the surface conduction electron-emitting elements 74 are electrically connected to one of DX1, DX2, . . . , DXm, i.e., the m lines of X-direction wire 72 and one of DY1, DY2, . . . , DYn, i.e., the n lines of Y-direction wire 73, respectively, by the connecting electrodes 75 made of a thin film of a conductive metal or the like which is formed by vacuum evaporation, printing, sputtering or the like.

The conductive metals or other materials used for the m lines of X-direction wire 72, the n lines of Y-direction wire 73, the connecting electrodes 75 and the opposite element electrodes may be the same as a part or all of the constituent elements, or may be different from one another. Specifically, those materials are selected as desired from metals such as Ni, Cr, Au, Mo, W. Pt, Ti, Al, Cu and Pd or alloys thereof, printing conductors comprising metals such as Pd, Ag, Au, $RuO_2$ and Pd-Ag or oxides thereof, glass, etc., transparent conductors such as $In_2O_3$-$SnO_2$, and semiconductors such as polysilicon.

The X-direction wire 72 is electrically connected to a scan signal generating means (not shown) for applying a scan signal to scan each row of the surface conduction electron-emitting elements 74 arrayed in the X-direction as desired.

On the other hand, the Y-direction wire 73 is electrically connected to a modulation signal generating means (not shown) for applying a modulation signal to modulate each column of the surface conduction electron-emitting elements 74 arrayed in the Y-direction as desired.

Additionally, a driving voltage applied to each of the surface conduction electron-emitting elements is supplied as a differential voltage between the scanning signal and the modulation signal both applied to that element.

By utilizing the surface conduction electron-emitting elements which are arranged and given specific characteristics as described above, in the arrangement (simple matrix arrangement) of the surface conduction electron-emitting elements 74 wherein the pair of element electrodes (not shown) for each element are connected to the m lines of row (X-direction) wire 72 and the n lines of column (Y-direction) wire 73 by the connecting electrodes 75 as shown in FIG. 18, any desired one of the numerous elements arrayed into a matrix pattern can be selected to emit electrons therefrom. Practically, that process can be effected in FIG. 18 by applying voltages V1, V2 to the X-direction wire 72 and the Y-direction wire 73 to which the element to be selected is connected, respectively, the voltages V1, V2 being selected so that the differential voltage between V1 and V2 exceeds Vth.

For example, by applying 0 V to DX3 and a voltage of 2×Vth to DY3 and applying a voltage of Vth to all the other lines of X-direction wire 72 and Y-direction wire 73, only surface conduction electron-emitting element having the pair of element electrodes connected respectively to DX3 and DY3 is supplied with the voltage (differential voltage= 2×Vth) exceeding the threshold value Vth, and all the other elements are supplied with the differential voltage not greater than the threshold value Vth. Therefore, only the electron-emitting element which is connected to the leads DX3 and DY3 can be selected. Also, by changing the time during which the differential voltage is generated, or changing the magnitude of the differential voltage in the range where the conditions of exceeding Vth are satisfied, the amount of electrons emitted from that element can be controlled.

Furthermore, the present invention has the following feature. When driving the electron source, the voltage applied to the column wire electrodes corresponding to a modulation signal, preferably, is set to be always higher than or equal to the voltage applied to the row wire electrodes corresponding a scanning signal. Then, the electrodes of each electron source element are arranged such that the electron-emitting region is surrounded in at least three directions, when viewed as from above the substrate, by at least one of the row wire electrode, the connecting electrode for connecting the row wire electrode and the element electrode, and the element electrode connected to the row wire electrode. As a result, when the electron-emitting region emits electrons, it is surrounded in at least three directions by the electrodes, which are supplied with lower one of the voltages applied to the pair of element electrodes, in the vicinity of the electron-emitting region.. Therefore, an electron beam is converged under action of the electric field generated in the vicinity of the electron-emitting region.

In the present invention, as will be apparent, the means for converging the electron beam can be achieved without adding any special means or methods to the above-described method of selecting and controlling desired one of the numerous electron-emitting elements by utilizing the specific characteristics of the surface conduction electron-emitting elements.

After that, by arranging a face plate, which has a fluorescent substance or film formed on its inner surface for emitting visible light upon impingement of electrons and an electrode supplied with an accelerating voltage for accelerating electrons to impinge against the fluorescent substance, in opposite relation to the substrate on which the electron source is fabricated as described above, it is possible to control any light emitting point over the fluorescent substance and the amount of light emitted therefrom as desired with the simple structure, and to complete an image display device which can produce a highly accurate image.

Further, according to the concept of the present invention, the above image display device can also be used in an optical printer, which comprises a photosensitive drum, light-emitting diodes and so on, as a light-emitting source instead of the light-emitting diodes. In this case, by properly selecting the m lines of row wire and the n lines of column wire, the image display device can be employed as a two-dimensional light-emitting source rather than being simply used as a linear light-emitting source.

The present invention will be described below in more detail with reference to Examples.

Example 1

Figure 1:
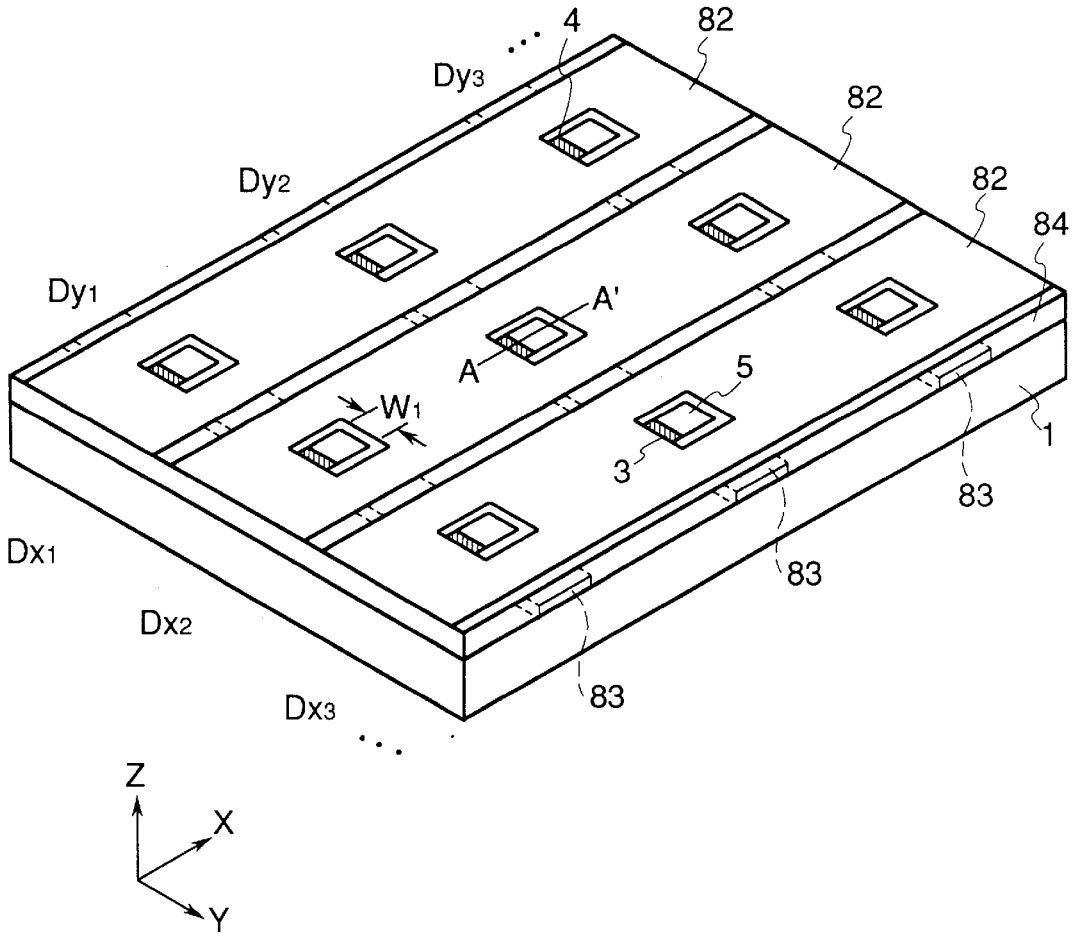
FIG. 1 is a perspective view of an electron source according to a first embodiment of the present invention.
Figure 2:
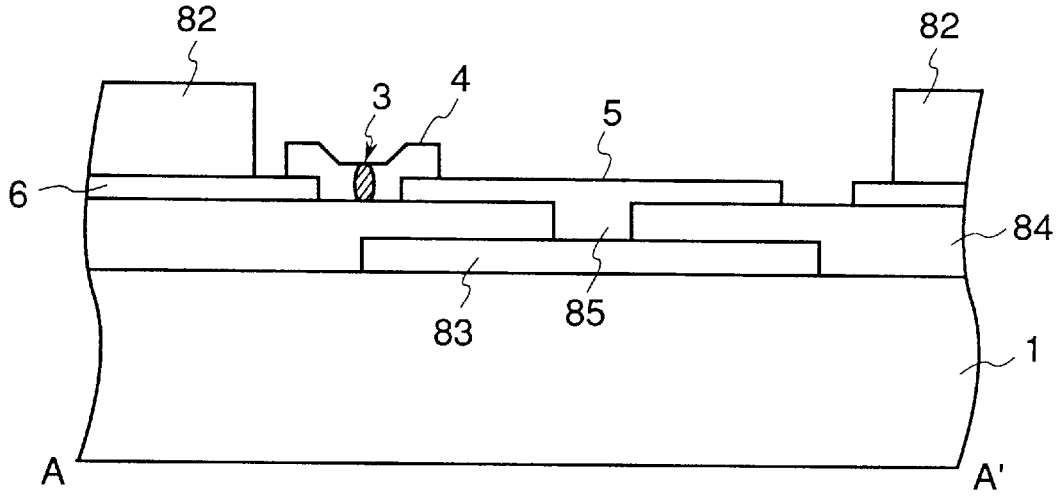
FIG. 2 is a partial enlarged sectional view of the electron source of the present invention.
Figure 3A:
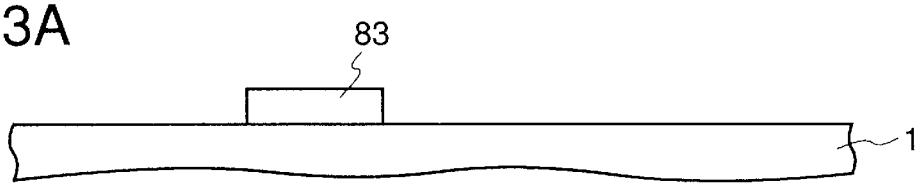
FIGS. 3A to 3H are sectional views showing successive steps of a process for manufacturing the electron source of the present invention.
Figure 3B:
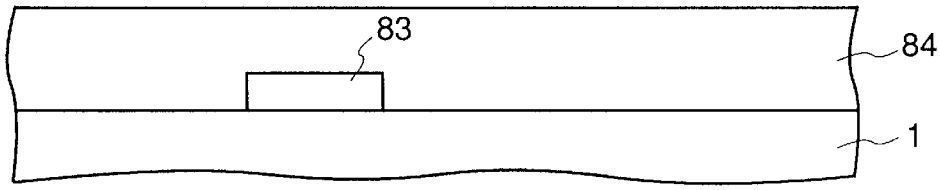
Figure 3C:
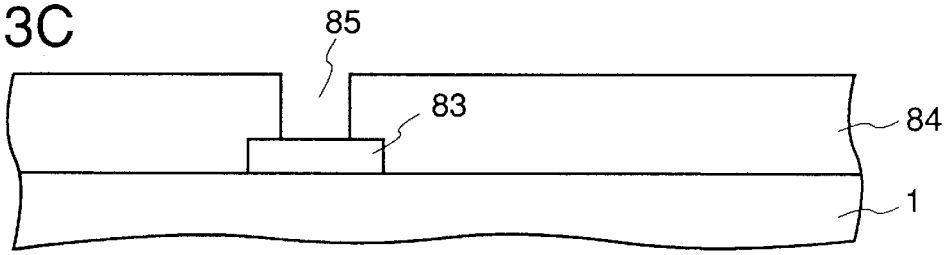
Figure 3D:
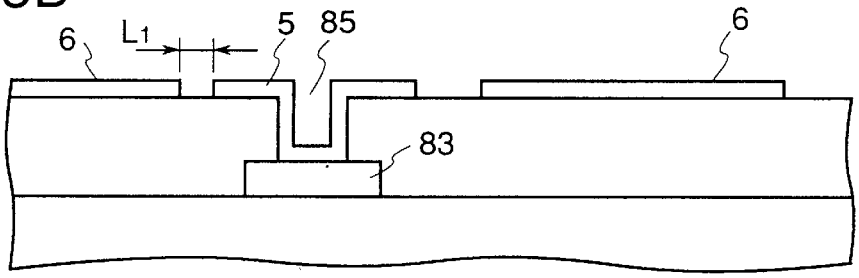
Figure 3E:
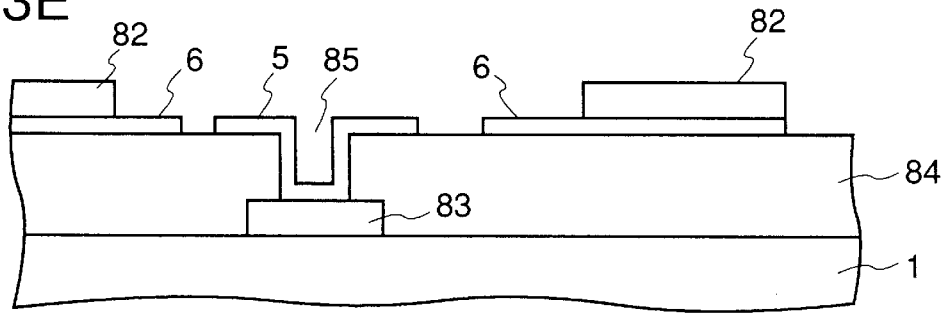
Figure 3F:
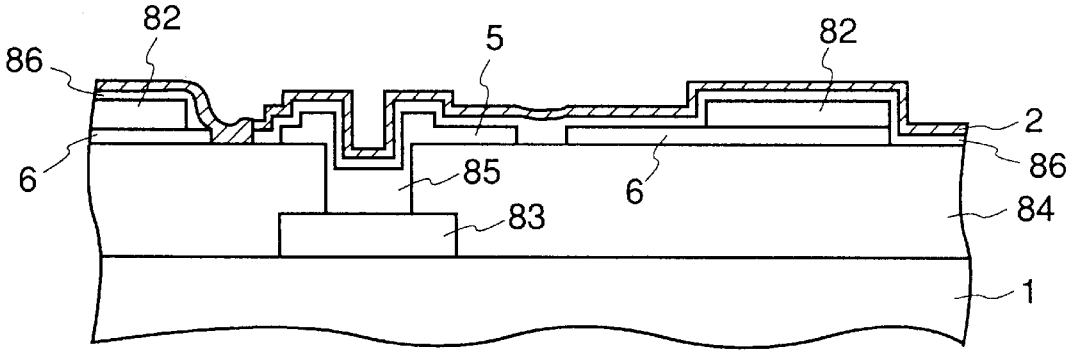
Figure 3G:
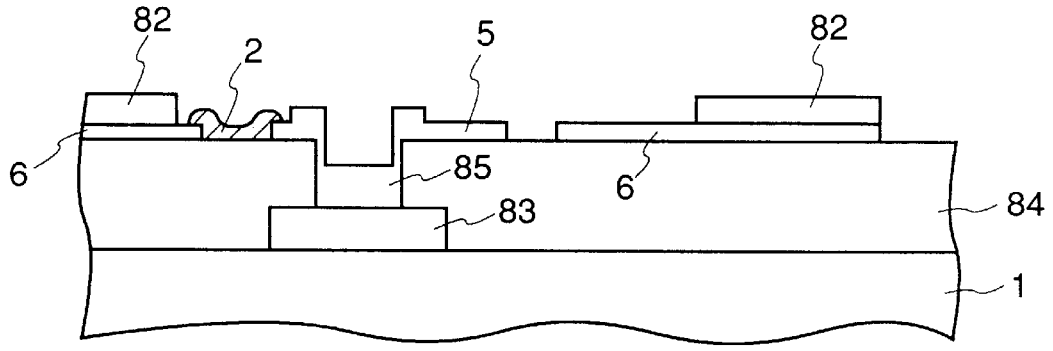
Figure 3H:
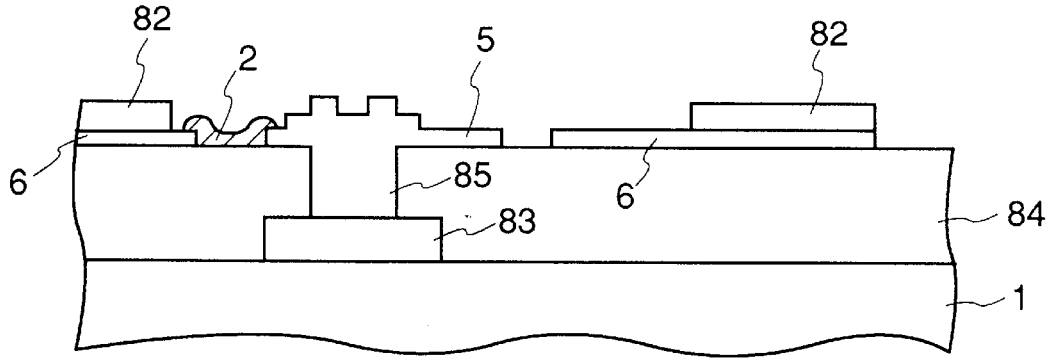

FIG. 1 shows a part of the electron source as a perspective view. FIG. 2 shows a section taken along line A - A' in FIG. 1. In FIGS. 1, 2 and 3A to 3H, the same reference numerals denote the same components. Denoted by 1 is an insulating substrate, 82 is an X-direction wire (also called an upper lead) corresponding to DXn in FIG. 18, 83 is a Y-direction wire (also called a lower lead) corresponding to DYn in FIG. 18, 4 is an electron-emitting region including thin film, 5 and 6 are element electrodes, 84 is an interlayer insulating layer, and 85 is a contact hole for electrical connection between the element electrode 5 and the lower lead 83.

The manufacture process will now be described in detail in the order to successive steps with reference to FIGS. 3A to 3H.

Step-a

A silicon oxide film being 0.5 micron thick was formed on a washed soda lime glass, as a substrate 1, by sputtering. A Cr film being 50 A thick and an Au film being 6000 A thick were then laminated on the substrate 1 in this order by vacuum evaporation. A photoresist (AZ1370, by Hoechst Co.) was coated thereon under rotation by using a spinner and then baked. Thereafter, by exposing and developing a photomask image, a resist pattern for the lower leads 83 was formed. The deposited Au/Cr films were selectively removed by wet etching to thereby form the lower leads 83 in the desired pattern.

Step-b

Then, the interlayer insulating layer 84 formed of a silicon oxide film being 1.0 micron thick was deposited over the entire substrate by RF sputtering.

Step-c

A photoresist pattern for forming the contact holes 85 in the silicon oxide film deposited in Step-b was coated and, by using it as a mask, the interlayer insulating layer 84 was selectively etched to form the contact holes 85. The etching was carried out by the RIE (Reactive Ion Etching) process using a gas mixture of $CF_4$ and $H_2$.

Step-d

A photoresist (RD-2000N-41, by Hitachi Chemical Co., Ltd.) was formed in a pattern to coat gaps L1 between the element electrodes 5 and 6. A Ti film being 50 A thick and a Ni film being 1000 A thick were then deposited thereon in this order by vacuum evaporation. The photoresist pattern was dissolved by an organic solvent to leave the deposited Ni/Ti films by liftoff, whereby the element electrodes 5, 6 each having the width W1 of 300 microns were formed.

Step-e

A photoresist pattern for the upper leads 82 was formed on the element electrodes 5 and 6. A Ti film being 50 A thick and an Au film being 5000 A thick were then deposited thereon in this order by vacuum evaporation. The unnecessary photoresist pattern was removed to form the upper leads 82 by liftoff.

Step-f

Figure 4:
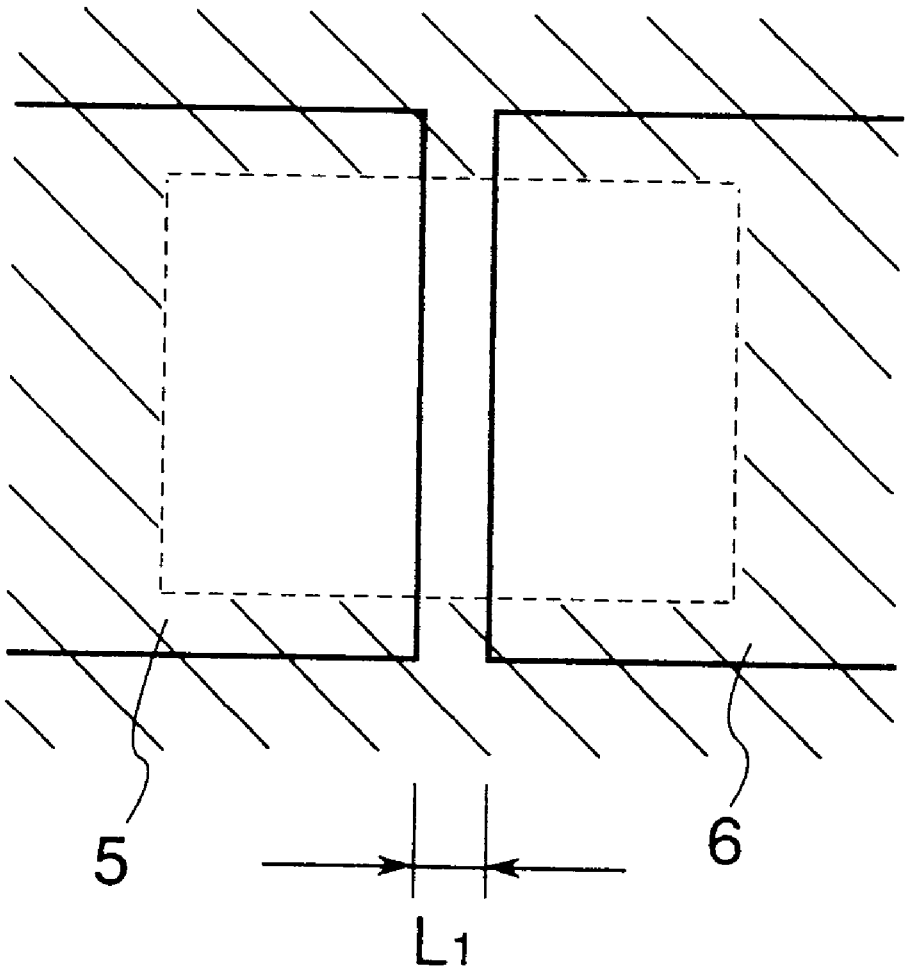
FIG. 4 is a view of a mask for producing an electron-emitting region forming thin film in the electron source of the present invention.

FIG. 4 shows, in plan view, a part of a mask used in this step to form the electron-emitting region forming thin film 2 of the electron-emitting element. The mask has an opening covering each gap L1 between the element electrodes and the vicinity thereof. A Cr film 86 being 1000 A thick was deposited by vacuum evaporation and patterned by using the mask. An organic Pd (ccp4230, by Okuno Pharmaceutical Co., Ltd.) was coated thereon under rotation by using a spinner and then heated for baking at 300° C. for 10 minutes. The electron-emitting region forming thin film 2 thus formed and comprising fine particles of Pd as a primary constituent element had a thickness of 100 angstroms and a sheet resistance value of $5\times10^4$ ohms/□. The term "fine particle film" used herein means, as previously described, a film comprising a number of fine particles aggregated together, and includes films having micro structures in which fine particles are not only individually dispersed, but also adjacent to or overlapped with each other (including an island state).

Step-g

The Cr film 86 and the electron-emitting region forming thin film 2 after the baking were etched by an acid etchant to be formed into the desired pattern.

Step-h

A resist was coated in a pattern to cover the surface other than the contact holes 85. A Ti film being 50 A thick and an Au film being 5000 A thick were then deposited thereon in this order by vacuum evaporation. The unnecessary photoresist pattern was removed to fill the contact holes 85 by liftoff.

As a result of the above steps, the lower leads 83, the interlayer insulating layer 86, the upper leads 82, the element electrodes 5, 6, the electron-emitting region forming thin films 2, etc. were formed on the insulating substrate 1.

A description will now be made, with reference to FIG. 5, of an example in which an image display device is constructed by using the electron source manufactured as above.

The substrate 1 on which a number of surface conduction electron-emitting elements were manufactured through the foregoing steps was fixed onto a rear plate 91. Then, a face plate 95 (fabricated by laminating a fluorescent film 93 and a metal back 94 on an inner surface of a glass substrate 92 in this order) is disposed 5 mm above the substrate 1 through a support frame 96 and, after applying frit glass to joined portions between the face plate 95, the support frame 96 and the rear plate 91, the assembly was baked in the atmosphere or nitrogen atmosphere at 400° C. to 500° C. for 10 minutes or more for sealing the joined portions. Frit glass was also used to fix the substrate 1 to the rear plate 91.

Figure 5:
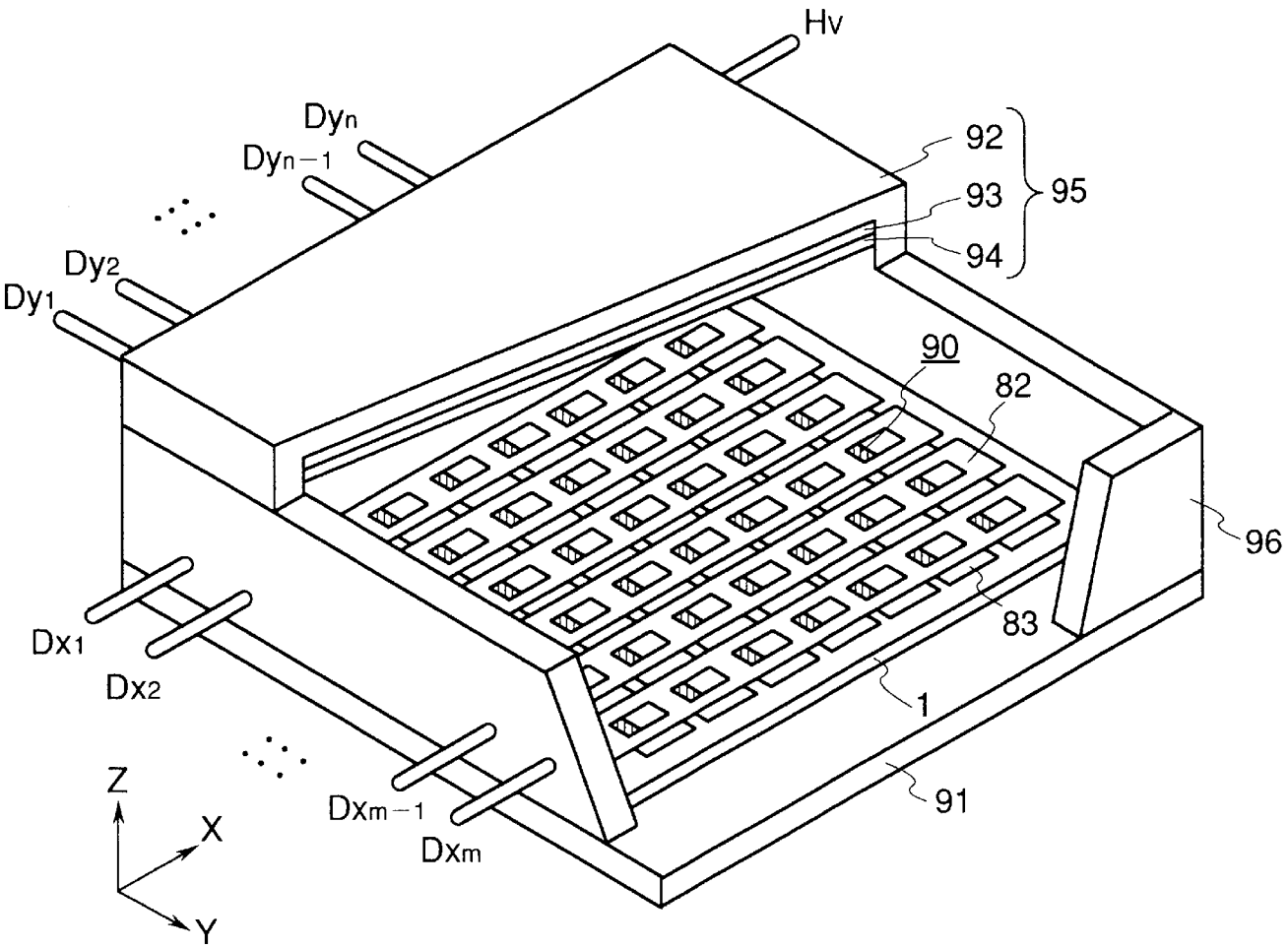
FIG. 5 is a perspective view of an image display device using the electron source according to the first embodiment of the present invention.

In FIG. 5, denoted by 90 is an electron-emitting region and 82, 83 are X- and Y-direction wires, respectively.

The fluorescent film 93 comprises only a fluorescent substance in the monochrome case. For producing a color image, this Example employs a stripe pattern of fluorescent substances. Thus, the fluorescent film 93 was fabricated by first forming black stripes and then coating fluorescent substances in respective colors in gaps between the black stripes. The black stripes were formed by using a material containing graphite as a primary component which is usually employed.

Fluorescent substances were coated on the glass substrate 92 by the slurry method.

On the inner surface of the fluorescent film 93, the metal back 94 is usually disposed. The metal back 94 was fabricated by smoothing the inner surface of the fluorescent film (this step being usually called filming) and then forming an Al film by vacuum evaporation.

To increase conductivity of the fluorescent film 93, the face plate 95 may be provided with a transparent electrode (not shown) between the glass substrate 92 and the fluorescent film 93 in some cases. Such a transparent electrode was not provided in this Example because sufficient conductivity was obtained with the metal back 94 only.

Before the above sealing, alignment of the respective parts was carried out with due care since the fluorescent substances in respective colors and the electron-emitting elements must be precisely aligned with each other in the color case.

The atmosphere in the glass envelope thus completed was evacuated by a vacuum pump through an evacuation tube (not shown). After reaching a sufficient degree of vacuum, a voltage was applied between the electrodes 5 and 6 of the electron-emitting elements 90 through terminals $D_{x1}$ to $D_{xm}$ and $D_{y1}$ to $D_{yn}$ outside the envelope for producing the electron-emitting regions 3 through the energizing process (i.e., forming process) of the electron-emitting region forming thin film 2. The voltage waveform used for the forming process is shown in FIG. 14.

In FIG. 14, T1 and T2 indicate a pulse width and interval of the voltage waveform, and were set in this Example to 1 millisecond and 10 milliseconds, respectively. The crest value of the triangular wave (i.e., the peak value during the forming) was set to 5 V, and the forming process was performed under vacuum atmosphere of about $1\times10^{-6}$ torr for 60 seconds.

The electron-emitting regions 3 thus formed were under a condition that fine particles containing paradium as a primary constituent element were dispersed therein and had an average particle diameter of 30 angstrom.

As a result of the above forming process, the electron-emitting regions 3 were formed and the electron-emitting elements 90 were fabricated.

Then, the evacuation tube (not shown) was heated and fused together by using a gas burner to hermetically seal the envelope while keeping a vacuum degree of about $10^{-6}$ torr in the envelope.

Additionally, to maintain the vacuum degree after the sealing, the envelope was subjected to the gettering process. This process was performed by, immediately before the sealing, heating a getter disposed in a predetermined position (not shown) in the image display device by high-frequency heating or the like so as to form an evaporation film of the getter. The getter contained Ba or the like as a primary component.

The method of driving the image display device will be described below.

Figure 20:
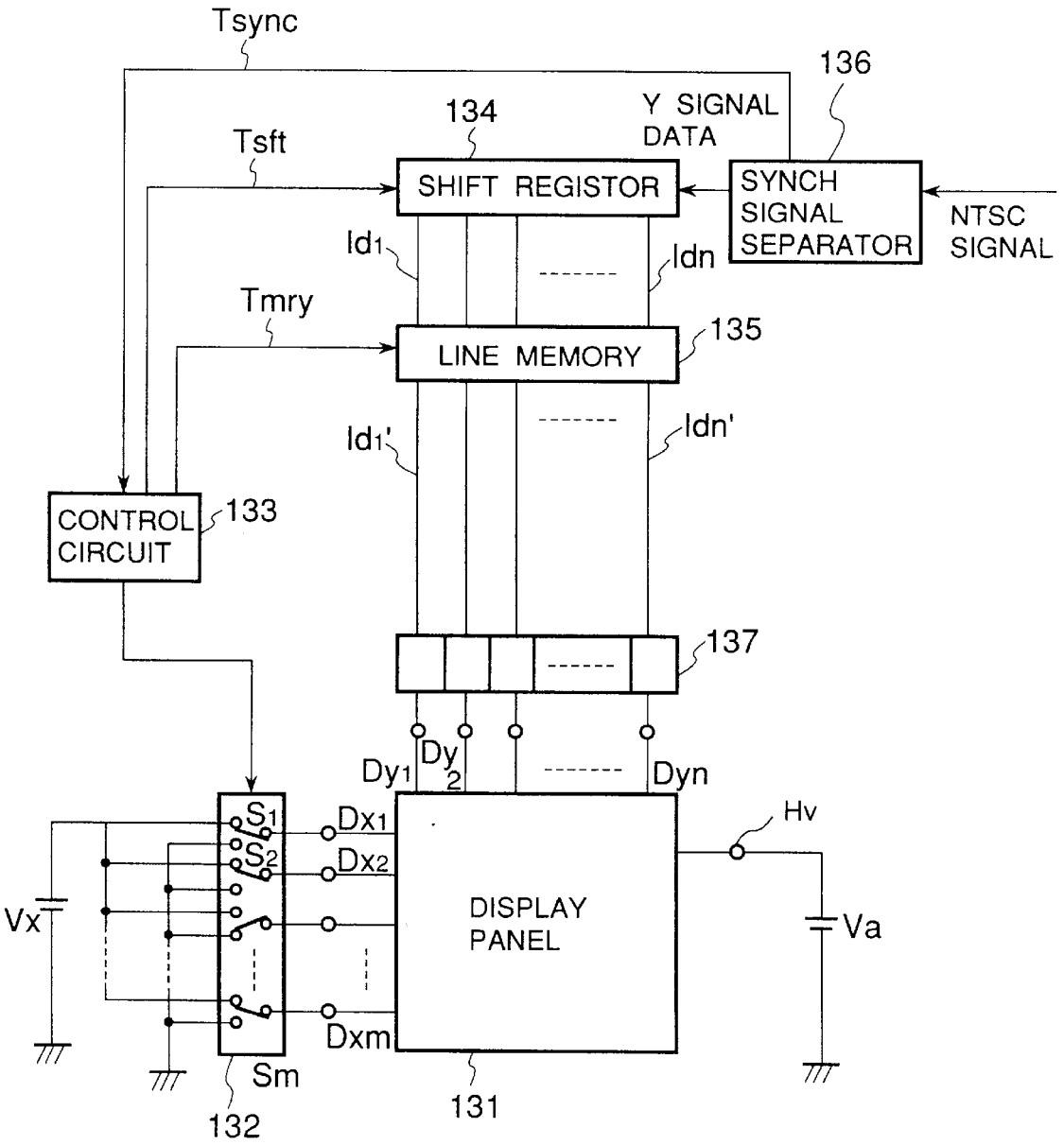
FIG. 20 is a block diagram showing the configuration of an electric circuit of an image-forming apparatus of the present invention.

FIG. 20 shows the configuration of an electric circuit of this Example. FIG. 20 is a block diagram of a driver for displaying television video information in accordance with an NTSC-standard TV signal. In the drawing, denoted by 131 is a display panel, 132 is a scanning circuit, 133 is a control circuit, 134 is a shift register, 135 is a line memory, 136 is a synch signal separator, 137 is a modulation signal generator, and $V_X$ and $V_a$ are DC power supplies.

Functions of those parts will be described. The display panel 131 is connected to the external electric circuits via terminals $D_{x1}$ to $D_{xm}$, $D_{y1}$ to $D_{yn}$ and a high-voltage terminal $H_V$. Applied to the terminals $D_{x1}$ to $D_{xm}$ is a scan signal for driving an electron beam multi-source disposed in the display panel 131, i.e., a group of surface conduction electron-emitting elements arrayed and wired into a matrix pattern of m-row×n-column, successively on a row-by-row basis (i.e., in units of n elements). Applied to the terminals $D_{y1}$ to $D_{yn}$ is a modulation signal for controlling an electron beam emitted from each of the surface conduction electron-emitting elements in the row selected by the scan signal. Also, supplied to the high-voltage terminal $H_V$ is a DC voltage of 10 kV, for example, from the DC power supply $V_a$ for accelerating electron beams emitted from the surface conduction electron-emitting elements so that the electron beams have enough energy to excite fluorescent substances.

The scanning circuit 132 includes m pieces of switching elements (schematically indicated by $S_1$ to $S_m$ in FIG. 20). The switching elements select either the output voltage of the DC voltage supply $V_X$ or 0 V (ground level), and introduces the selected voltage to the terminals $D_{x1}$ to $D_{xm}$ of the display panel 131. Each of the switching elements $S_1$ to $S_m$ is operated in accordance with a control signal $T_{scan}$ output from the control circuit 133 and, in practice, it can easily be constructed by combining FET switching elements, for example.

Taking into account the characteristics of the surface conduction electron-emitting elements, the DC voltage supply $V_X$ was set to output a constant voltage of 7 V in this Example.

The control-circuit 133 functions to coordinate operations of the respective parts so that proper display is performed in accordance with an image signal input from the outside. Specifically, in accordance with a synch signal $T_{synch}$ delivered from the synch signal separator 136, the control circuit 133 supplies control signals $T_{scan}$, $T_{sft}$ and $T_{mry}$ to the corresponding parts. The timed relationship between the control signals will be described below in detail with reference to FIGS. 25A to 25F.

The synch signal separator 136 is a circuit for separating the NTSC-standard TV signal input from the outside into a synch signal component and a luminance signal component. Such a circuit can easily be constructed by using a frequency separator (filter), as well known in the art. The synch signal component separated by the synch signal separator 136 comprises, as known, a vertical synch signal and a horizontal synch signal, but these signals are indicated together as a $T_{synch}$ signal for convenience of the description. On the other hand, the luminance signal component separated from the TV signal is indicated as a DATA signal and is input to the shift register 134.

The shift register 134 performs serial/parallel conversion of the DATA signal applied serially in time thereto for each line of an image. The shift register 134 operates in accordance with the control signal $T_{sft}$ supplied from the control circuit 133 (that is, the control signal $T_{sft}$ is a shift clock for the shift register 134). After the serial/parallel conversion, the resultant data of one image line (corresponding to data for driving n elements of the electron-emitting elements in one row) are output as n parallel signals $I_{d1}$ to $I_{dn}$ from the shift register 134.

The line memory 135 is a memory for storing the data of one image line for a period of time required. The line memory 135 stores the data of $I_{d1}$ to $I_{dn}$ from time to time in accordance with the control signal $T_{mry}$ supplied from the control circuit 133. The stored data are output as $I'_{d1}$ to $I'_{dn}$ and applied to the modulation signal generator 137.

Figure 26A:
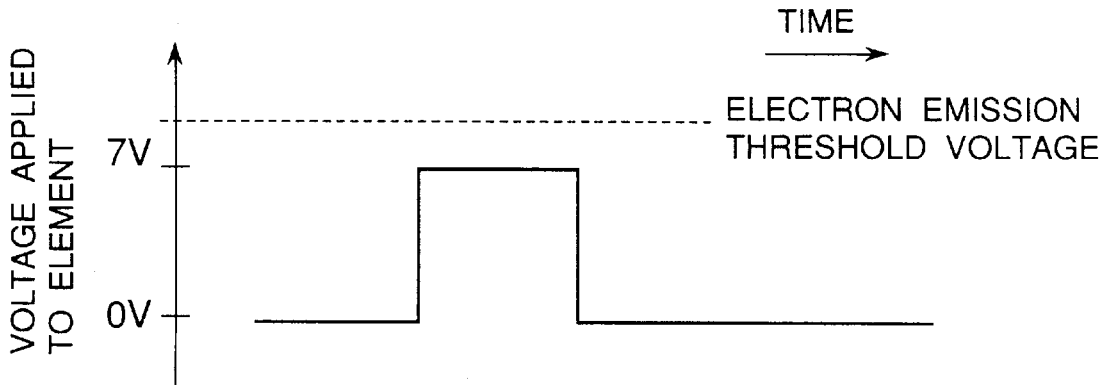
FIGS. 26A and 26B are charts showing a threshold characteristic of the surface conduction electron-emitting element according to the present invention.
Figure 26B:
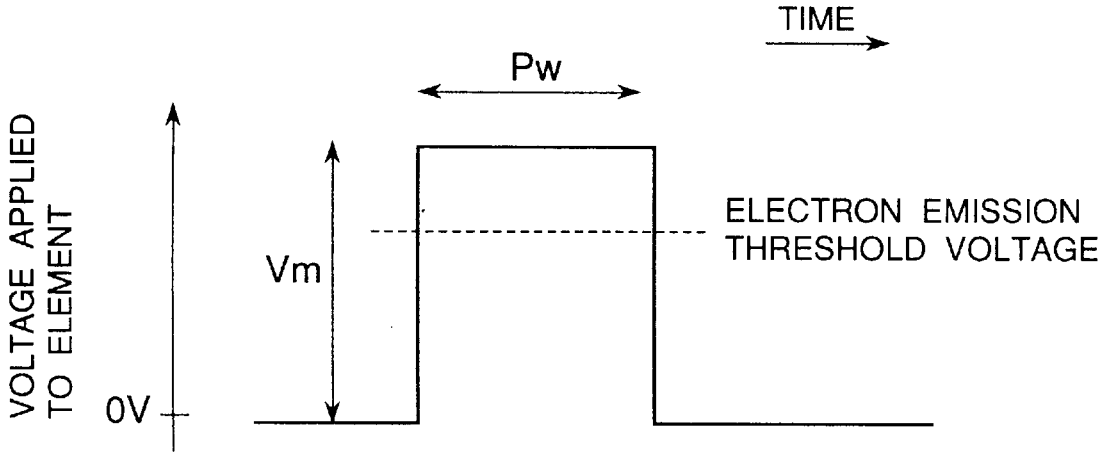

The modulation signal generator 137 is a signal source for properly driving and modulating the surface conduction electron-emitting elements in accordance with the image data $I'_{d1}$ to $I'_{dn}$, respectively. Output signals of the modulation signal generator 137 are applied to the surface conduction electron-emitting elements in the display panel 131 via the terminals $D_{y1}$ to $D_{yn}$. As previously described, the electron-emitting elements of the present invention have the three basic characteristics with respect to the emission current $I_e$. Therefore, each electron-emitting element does not emit electrons when a voltage lower than the electron emission threshold value is applied as shown in FIG. 26A, by way of example. But when a voltage higher than the electron emission threshold value is applied as shown in FIG. 26B, the emitted electron beam can be controlled by changing the width $P_W$ or crest value $V_m$ of an applied pulse. Accordingly, the modulation signal generator 137 may be of the pulse width modulation type that generates pulses at a constant voltage, but modulates widths of the pulses depending on the applied data, or the voltage modulation type that generates voltage pulses with a constant width, but modulates crest values of the pulses depending on the applied data.

The functions of the parts shown in FIG. 20 have been described above. Prior to describing the entire operation, the operation of the display panel 131 will be described in more detail with reference to FIGS. 21 to 24M.

For convenience of illustration, the following description will be made on an assumption that the display panel 131 has the number of pixels of 6×6 (i.e., m=n=6). It is however needless to say that the display panel 131 in practical use a number of pixels much greater than the illustrated one.

Figure 21:
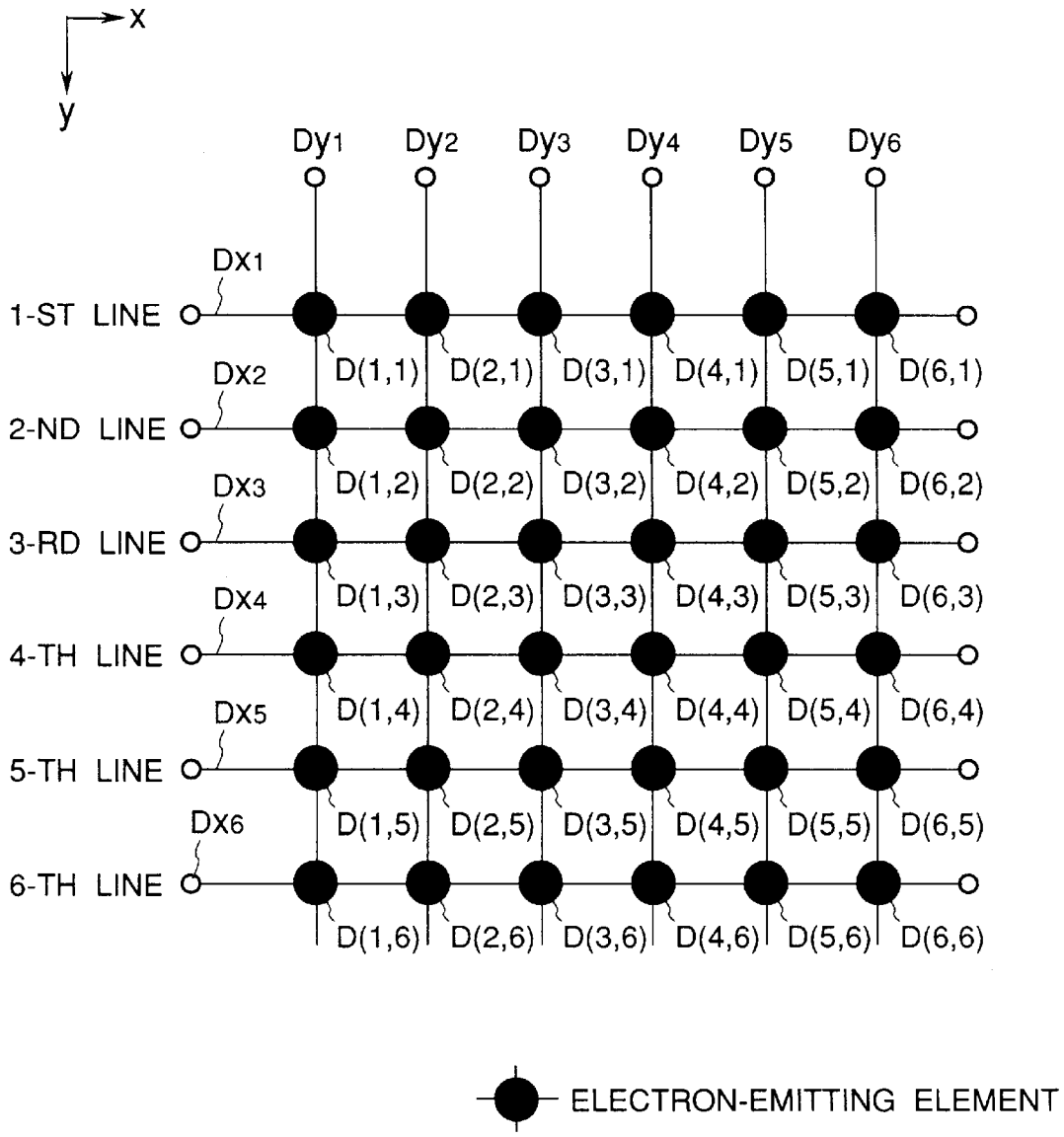
FIG. 21 is an illustration showing an example of the arrangement of an electron source according to the present invention.

FIG. 21 shows an electron beam multi-source according to the electron source of the present invention in which surface conduction electron-emitting elements are arrayed and wired in a matrix pattern of 6 rows×6 columns. The positions of the individual elements are indicated by (X, Y) coordinates, i.e., $D_{(1,1)}$, $D_{(1,2)}$, . . . , $D_{(6,6)}$, to discriminate them for the sake of the description.

When an image is displayed by driving such an electron beam multi-source, the image is formed in line sequence for each of image lines parallel to the X-axis. To drive the electron-emitting elements corresponding to one image line, a voltage of 0 V is applied to one terminal of $D_{x1}$ to $D_{x6}$ whose row corresponds to the line to be displayed, and a voltage of 7 V is applied to the other terminals. In synchronism therewith, the modulation signal is applied to the terminals $D_{y1}$ to $D_{yn}$ in accordance with the image pattern for that line.

The following description will be made by taking the case of displaying an image pattern shown in FIG. 22 as an example. For convenience of the description, it is assumed that light-emitting portions in the image pattern have the same luminance equivalent to, e.g., 100 foot-lambert. In the display panel 131, P-22 known in the art was used as the fluorescent substance, the accelerating voltage was set to 10 kV, the repeated frequency for display of one picture was set to 60 Hz, and the surface conduction electron-emitting elements having the above-described basic characteristics were used as the electron-emitting elements. In this case, it was appropriate to apply a voltage of 14 V for 14 $\mu$sec to the element corresponding to the light-emitting pixel for achieving the luminance of 100 foot-lambert. (Note that these values should of course be changed if the parameter values are varied.)

Figure 22:
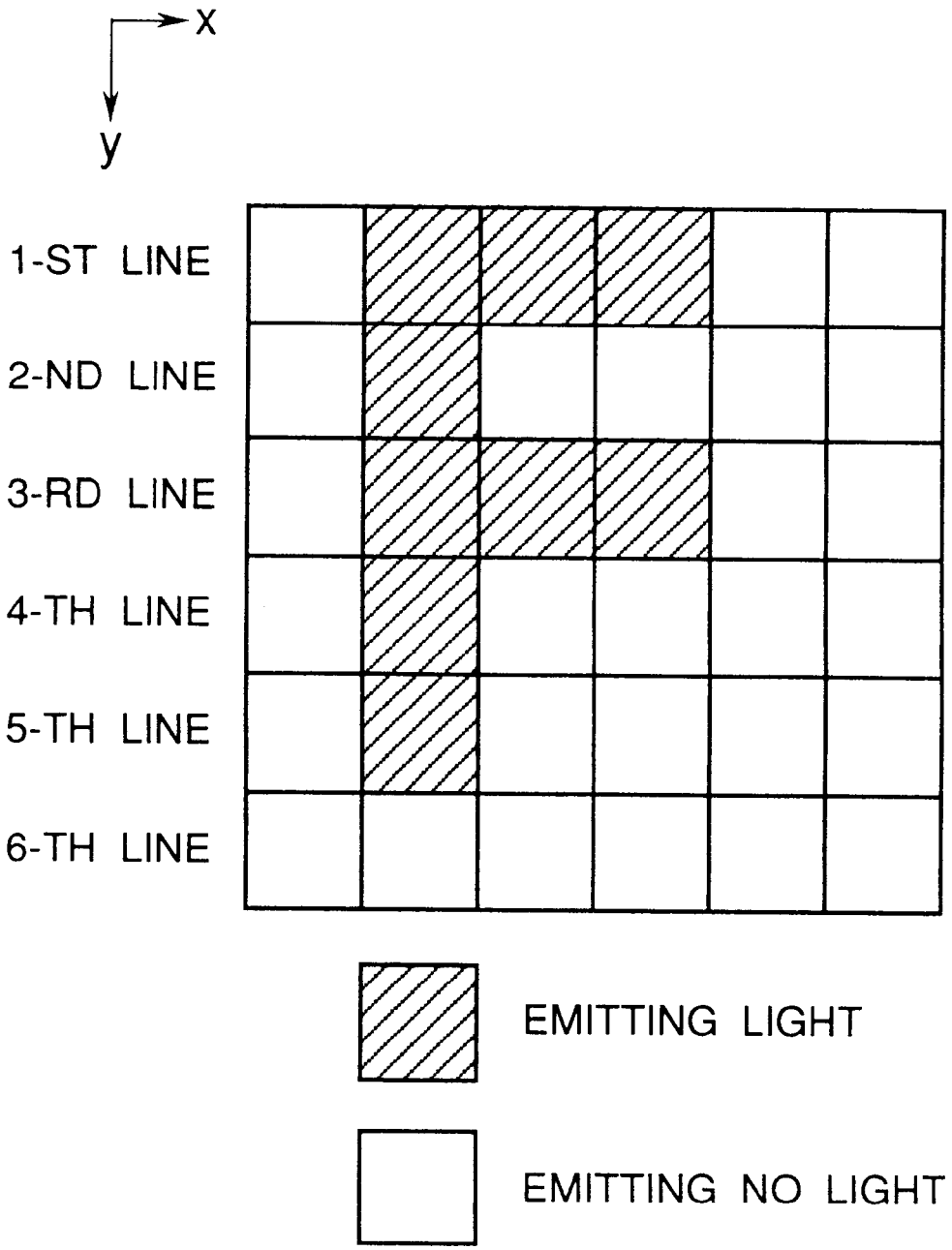
FIG. 22 is an illustration showing an example of an image pattern displayed by the electron source shown in FIG. 21.
Figure 23:
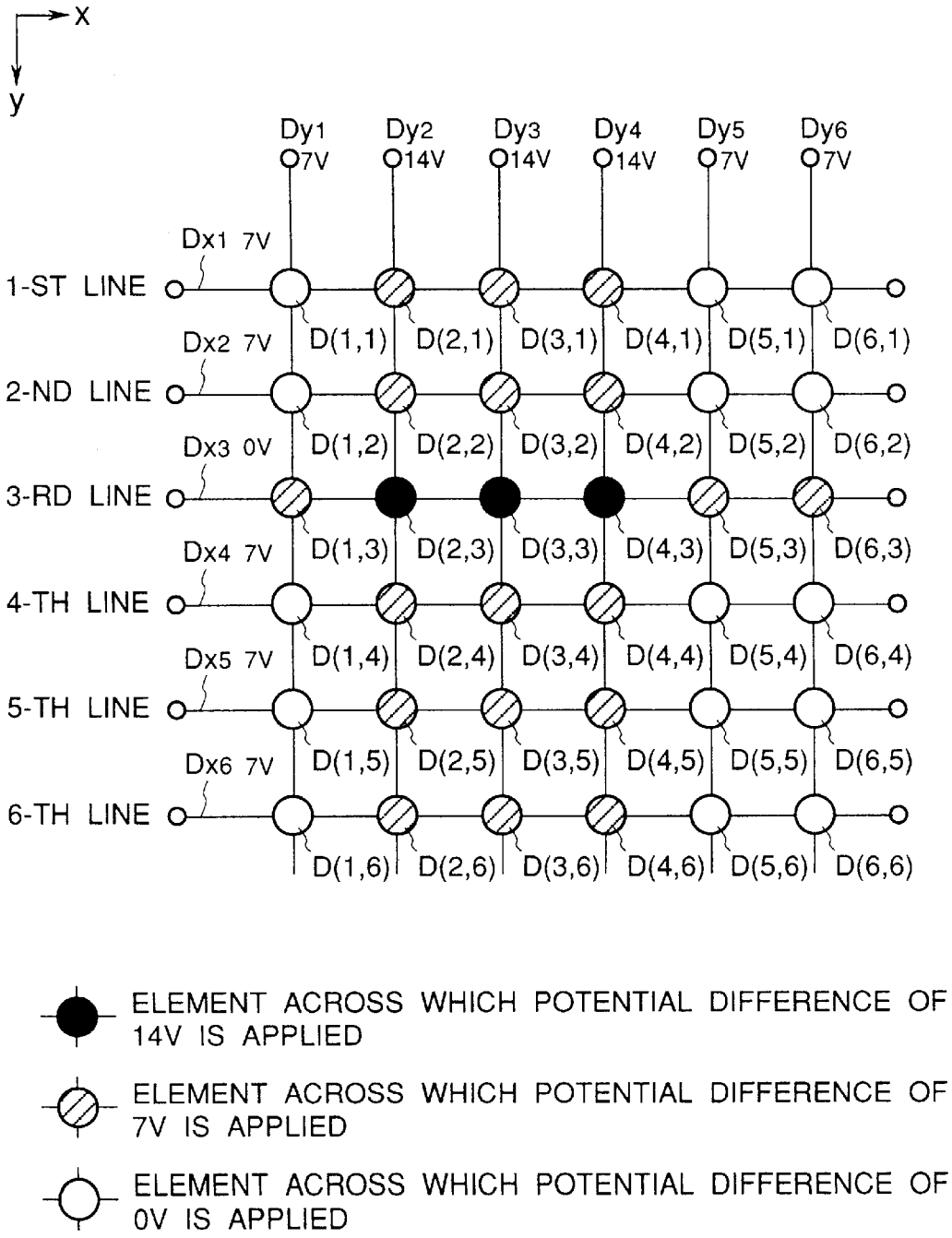
FIG. 23 is an illustration showing voltages applied to display the image pattern shown in FIG. 22.
Figures 24A, 24B, 24C, 24D, 24E, 24F, 24G, 24H, 24I, 24J, 24K, 24L, 24M:
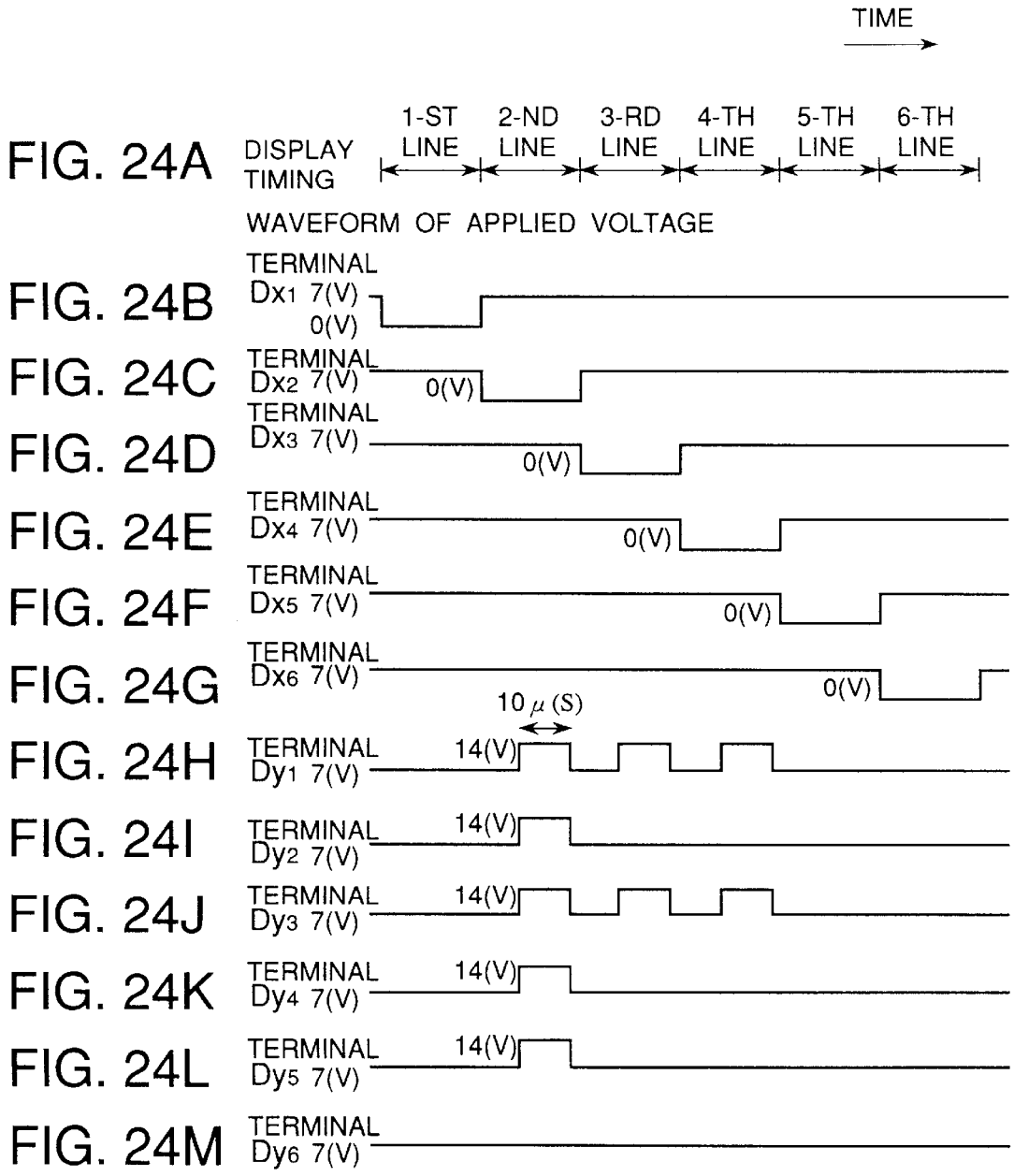
FIGS. 24A to 24M are timing charts to display the image pattern shown in FIG. 22.

During the period in which the third line, for example, in the image pattern of FIG. 22 is to emit light, voltages as shown in FIG. 23 are applied to the electron beam multi-source via the terminals $D_{x1}$ to $D_{x6}$ and $D_{y1}$ to $D_{y6}$. As a result, the surface conduction electron-emitting elements at $D_{(2,3)}$, $D_{(3,3)}$ and $D_{(4,3)}$ are supplied with 14 V to emit electron beams. The other elements than the above three are supplied with 7 V (i.e., the elements indicated by hatched circles) and 0 V (i.e., the elements indicated by white circles). Since these voltages are lower than the electron emission threshold value, these other elements do not emit electron beams.

For the other lines, the electron beam multi-beam is similarly driven in sequence in accordance with the display pattern of FIG. 22. This process is illustrated in a timing chart of FIGS. 24A to 24M in the time-series form. By driving the display panel successively from the first line to the sixth line one by one as shown in FIGS. 24A to 24M, one picture is displayed. By repeating the above process at a rate of 60 pictures per second, image display was obtained with no flicker.

The luminance of light emitted in the display pattern can be modulated by changing the width or crest value of voltage pulse of the modulation signal applied to the terminals $D_{y1}$ to $D_{y6}$.

The method of driving the display panel 131 has been described by taking the electron beam multi-source of 6×6 as an example. The entire operation of the image display device shown in FIG. 20 will be described below with reference to a timing chart of FIGS. 25A to 25F.

FIG. 25A shows the timing of the luminance signal DATA separated by the synch signal separator 136 from the NTSC signal input from the outside. The luminance signal DATA is supplied in sequence from the data of the first line, then the data of the second line, then the data of the third line, and so on as shown. In synchronism therewith, the shift clock $T_{sft}$ is output from the control circuit 133 to the shift register 134 as shown in FIG. 25B.

When the data of one line is loaded in the shift register 134, the memory write signal $T_{mry}$ is output from the control circuit 133 to the line memory 135 at the timing shown in FIG. 25C, whereupon the driving data of one line (i.e., n elements) is written into the line memory 135. As a result, the data $I'_{d1}$ to $I'_{dn}$ as output signals from the line memory 135 is changed at the timing shown in FIG. 25D.

On the other hand, the control signal $T_{scan}$ for controlling the operation of the scanning circuit 132 has the timing and data as shown in FIG. 25E. More specifically, the scanning circuit 132 is operated such that when driving the first line, only the switching element $S_1$ supplies 0 V and the other switching elements supply 7 V, and when driving the second line, only the switching element $S_2$ supplies 0 V and the other switching elements supply 7 V. For the remaining lines, the operation of the scanning circuit 132 is controlled in a like manner.

In synchronism with the above switching operation, the modulation signal is output from the modulation signal generator 137 to the display panel 131 at the timing shown in FIG. 25F.

Through the operation described above, television video information can be displayed by using the display panel 131.

Though not especially specified in the above description, the shift register 134 and the line memory 135 may be either digital or analog signal type so long as serial/parallel conversion and storage of the image signal are executed at a predetermined rate. In the case of using the digital signal type, the output signal DATA of the synch signal separator 136 must be converted into a digital signal. This conversion can easily be achieved by providing an A/D converter at the output of the synch signal separator 136.

While the above description has been made as displaying television video information in accordance with an NTSC-standard TV signal, applications of the display panel using the electron source of the present invention are not limited to such a case. The present electron source can be widely used in display devices which are directly or indirectly connected to various image signal sources including other type TV signals, computers, image memories and communication networks. In particular, the present electron source is suitable to display an image of large capacity on a large-size screen.

Figure 27:
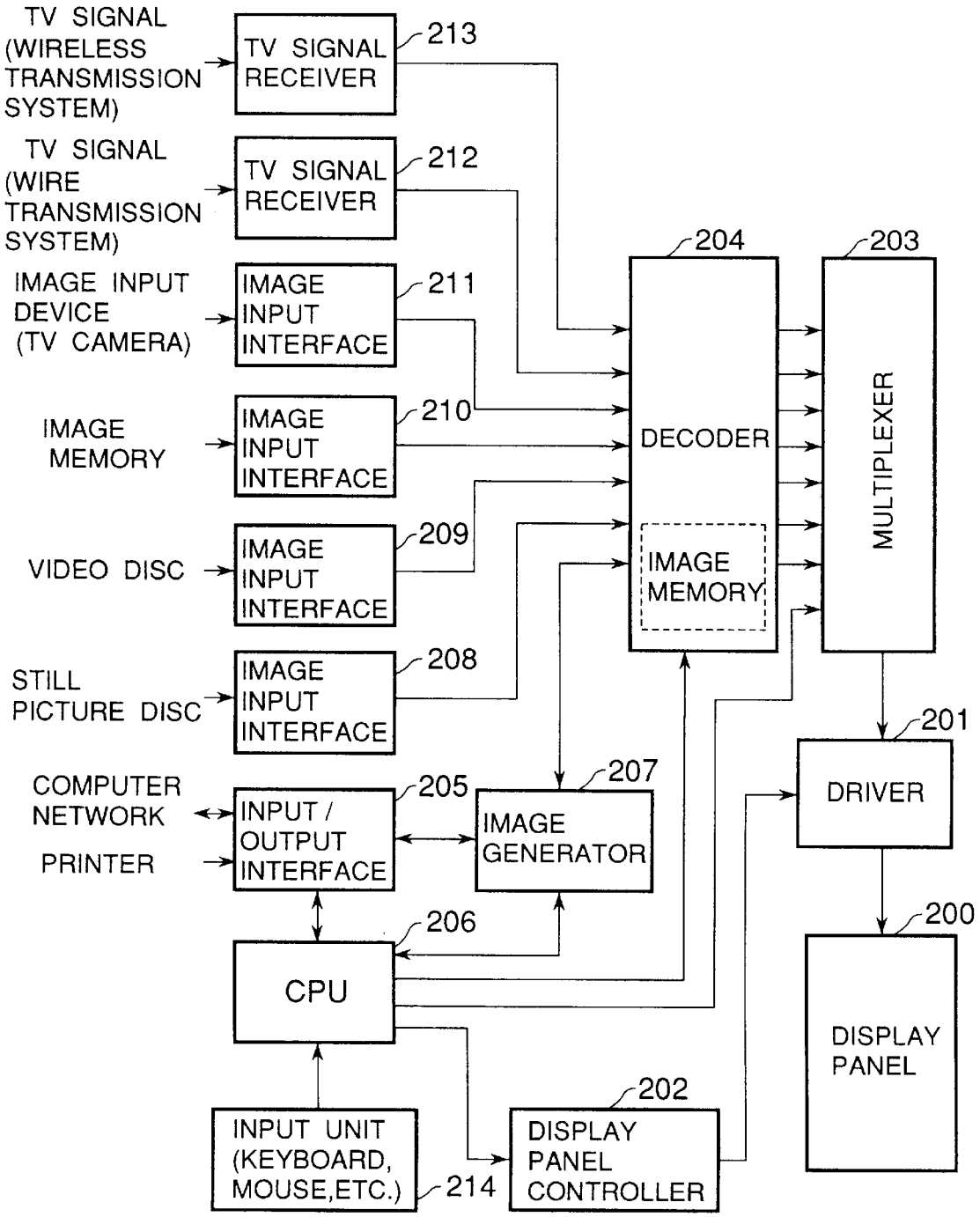
FIG. 27 is a block diagram of a display device according to the first embodiment of the present invention.

FIG. 27 is a block diagram showing one example of a display device in which a display panel using the above-described electron source of this Example is arranged to be able to display image information provided from various image information sources including TV broadcasting, for example. In FIG. 27, denoted by 200 is a display panel, 201 is a driver for the display panel, 202 is a display controller, 203 is a multiplexer, 204 is a decoder, 205 is an input/output interface, 206 is a CPU, 207 is an image generator, 208, 209 and 210 are image memory interfaces, 211 is an image input interface, 212 and 213 are TV signal receivers, and 214 is an input unit. (When the present display device receives a signal, e.g., a TV signal, including both video information and voice information, the device of course displays an image and reproduces voices simultaneously. But circuits, a speaker and so on necessary for reception, separation, reproduction, processing, storage, etc. of voice information, which are not directly related to the features of the present invention, will not be described here.)

Functions of the above parts will be described below along a flow of image signals.

First, the TV signal receiver 213 is a circuit for receiving a TV image signal transmitted through a wireless transmission system in the form of electric waves or spatial optical communication, for example. A type of the TV signal to be received is not limited to a particular one, but may be any type of the NTSC-, PAL- and SECAM-standards, for example. Another type of TV signal (e.g., so-called high-quality TV signal including the MUSE-standard type) having a larger number of scan lines than the above types is a signal source fit to utilize the advantage of the above-described display panel which is suitable for an increase in the screen size and the number of pixels. The TV signal received by the TV signal receiver 213 is output to the decoder 204.

Then, the TV signal receiver 212 is a circuit for receiving a TV image signal transmitted through a wire transmission system in the form of coaxial cables or optical fibers. As with the TV signal receiver 213, a type of the TV signal to be received by the TV signal receiver 212 is not limited to a particular one. The TV signal received by the receiver 212 is also output to the decoder 204.

The image input interface 211 is a circuit for taking in an image signal supplied from an image input unit such as a TV camera or an image reading scanner, for example. The image signal taken in by the interface 211 is output to the decoder 204.

The image memory interface 210 is a circuit for taking in an image signal stored in a video tape recorder (hereinafter abbreviated to a VTR). The image signal taken in by the interface 210 is output to the decoder 204.

The image memory interface 209 is a circuit for taking in an image signal stored in a video disk. The image signal taken in by the interface 209 is output to the decoder 204.

The image memory interface 208 is a circuit for taking in an image signal from a device storing still picture data, such as a so-called still picture disk. The image signal taken in by the interface 208 is output to the decoder 204.

The input/output interface 205 is a circuit for connecting the display device to an external computer or computer network, or an output device such as a printer. It is possible to perform not only input/output of image data and character/figure information, but also input/output of a control signal and numeral data between the CPU 206 in the display device and the outside in some cases.

The image generator 207 is a circuit for generating display image data based on image data and character/figure information input from the outside via the input/output interface 205, or image data and character/figure information output from the CPU 206. Incorporated in the image generator 207 are, for example, a rewritable memory for storing image data and character/figure information, a read only memory for storing image patterns corresponding to character codes, a processor for image processing, and other circuits required for image generation.

The display image data generated by the image generator 207 is usually output to the decoder 204, but may also be output to an external computer network or a printer via the input/output interface 205 in some cases.

The CPU 206 carries out primarily operation control of the display device and tasks relating to generation, selection and editing of a display image.

For example, the CPU 206 outputs a control signal to the multiplexer 203 for selecting one of or combining image signals to be displayed on the display panel as desired. In this connection, the CPU 206 also outputs a control signal to the display panel controller 202 depending on the image signal to be displayed, thereby properly controlling the operation of the display device in terms of picture display frequency, scan mode (e.g., interlace or non-interlace), the number of scan lines per picture, etc.

Furthermore, the CPU 206 outputs image data and character/figure information directly to the image generator 207, or accesses to an external computer or memory via the input/output interface 205 for inputting image data and character/figure information.

It is a matter of course that the CPU 206 may be used in relation to any suitable tasks for other purposes than the above. For example, the CPU 206 may directly be related to functions of producing or processing information as with a personal computer or a word processor.

Alternatively, the CPU 206 may be connected to an external computer network via the input/output interface 205, as mentioned above, to execute numerical computations and other tasks in cooperation with external equipment.

The input unit 214 is employed when a user enters commands, programs, data, etc. to the CPU 206, and may be any of various input equipment such as a keyboard, mouse, joy stick, bar code reader, and voice recognition device.

The decoder 204 is a circuit for reverse-converting various image signals input from the circuits 207 to 213 into signals for three primary colors, or a luminance signal, an I signal and a Q signal. As indicated by dot lines in the drawing, the decoder 204 preferably includes an image memory therein. This is because the decoder 204 also handles those TV signals including the MUSE-standard type, for example, which require an image memory for the reverse-conversion. Further, the provision of the image memory brings about an advantage of making it possible to easily display a still picture, or to easily perform image processing and editing, such as thinning-out, interpolation, enlargement, reduction and synthesis of images, in cooperation with the image generator 207 and the CPU 206.

The multiplexer 203 selects a display image in accordance with the control signal input from the CPU 206 as desired. In other words, the multiplexer 203 selects desired one of the reverse-converted image signals input from the decoder 204 and outputs it to the driver 201. In this connection, by switchingly selecting two or more of the image signals in a display time for one picture, different images can also be displayed in plural respective areas defined by dividing one screen as with the so-called multiscreen television.

The display panel controller 202 is a circuit for controlling the operation of the driver 201 in accordance with a control signal input from the CPU 206.

As a function relating to the basic operation of the display panel, the controller 202 outputs to the driver 201 a signal for controlling, by way of example, the operation sequence of a power supply (not shown) for driving the display panel.

Also, as a function relating to a method of driving the display panel, the controller 202 outputs to the driver 201 signals for controlling, by way of example, a picture display frequency and a scan mode (e.g., interlace or non-interlace).

Depending on cases, the controller 202 may output to the driver 201 control signals for adjustment of image quality in terms of luminance, contrast, tone and sharpness of the display image.

The driver 201 is a circuit for producing a drive signal applied to the display panel 200. The driver 201 is operated in accordance with the image signal input from the multiplexer 203 and the control signal input from the display panel controller 202.

With the various components arranged as shown in FIG. 27 and having the functions as described above, the display device can display image information input from a variety of image information sources on the display panel 200. More specifically, various image signals including the TV broadcasting signal are reverse-converted by the decoder 204, and at least one of them is selected by the multiplexer 203 upon demand and then input to the driver 201. On the other hand, the display controller 202 issues a control signal for controlling the operation of the driver 201 in accordance with the image signal to be displayed. The driver 201 applies a drive signal to the display panel 200 in accordance with both the image signal and the control signal. An image is thereby displayed on the display panel 200. A series of operations mentioned above are controlled under supervision of the CPU 206.

In addition to simply displaying the image information selected from plural items with the aid of the image memory built in the decoder 204, the image generator 207 and the CPU 206, the present display device can also perform, on the image information to be displayed, not only image processing such as enlargement, reduction, rotation, movement, edge emphasis, thinning-out, interpolation, color conversion, and conversion of image aspect ratio, but also image editing such as synthesis, erasure, coupling, replacement, and inset. Although not especially specified in the description of this Example, there may also be provided a circuit dedicated for processing and editing of voice information, as well as the above-explained circuits for image processing and editing.

Accordingly, even a single unit of the present display device can have functions of a display for TV broadcasting, a terminal for TV conferences, an image editor handling still and motion pictures, a computer terminal, an office automation terminal including a word processor, a game machine and so on; hence it can be applied to very wide industrial and domestic fields.

It is needless to say that FIG. 27 only shows one example of the configuration of the display device using the display panel in which the electron source comprises surface conduction electron-emitting elements, and the present invention is not limited to the illustrated example. For example, those circuits of the components shown in FIG. 27 which are not necessary for the purpose of use may be dispensed with. On the contrary, depending on the purpose of use, other components may be added. When the present display device is employed as a TV telephone, it is preferable to provide, as additional components, a TV camera, an audio microphone, an illuminator, and a transmission/reception circuit including a modem.

In the present display device, particularly, the display panel having the electron source which comprises surface conduction electron-emitting elements can easily be reduced in thickness and, therefore, the display device can have a smaller depth. Additionally, since the display panel having the electron source which comprises surface conduction electron-emitting elements can easily increase the screen size and also can provide high luminance and a superior characteristic of viewing angle, the present display device can display a more realistic and impressive image with good viewability.

For grasping characteristics of the planar type surface conduction electron-emitting element manufactured through the aforementioned steps, a standard comparative sample having the same dimensions, including L1 and W, as the planar type surface conduction electron-emitting element shown in FIGS. 12A and 12B was simultaneously manufactured in the same manner, and its electron emission characteristic was measured by using the measuring and evaluating device shown in FIG. 15.

Measuring conditions for the comparative sample were set as follows: the distance between the anode electrode and the electron-emitting element; 4 mm, the potential at the anode electrode; 1 kV, and the vacuum degree in the vacuum apparatus during measurement of the electron emission characteristic; $1\times10^{-6}$ torr.

As a result of applying the element voltage between the element electrodes 5 and 6 of the comparative sample and measuring the element current If and the emission current Ie which flowed under that condition, the current - voltage characteristic as shown in FIG. 16 was obtained. In this comparative sample, the emission current Ie started increasing abruptly when the element voltage reached about 8 V. At the element voltage of 14 V, the element current If was 2.2 mA, the emission current Ie was 1.1 $\mu$A, and the electron emission efficiency $\eta$=Ie/If (%) was 0.05%.

In the image display device constructed as above, when a signal generator and a voltage generator (both not shown) are operated to apply a voltage corresponding to a scan signal to the X-direction lead electrode and a voltage corresponding to an information, e.g., video, signal to the Y-direction lead electrode for thereby producing a differential voltage across the surface conduction electron-emitting element connected to both the X- and Y-direction lead electrodes, the electron emission characteristic of the surface conduction electron-emitting element has a threshold value with respect to the applied voltage and hence emission of electrons from the element can be controlled, as previously described.

Furthermore, the present invention is featured in that the voltage applied to the Y-direction wire electrodes corresponding to a modulation signal is set to be always higher than or equal to the voltage applied to the X-direction wire electrodes corresponding to a scanning signal for thereby producing a differential voltage, and that each of the electron-emitting regions is surrounded in at least three directions, when viewed from above the substrate, by at least one of the X-direction wire electrode, the connecting electrode for connecting the X-direction wire electrode and the element electrode, and the element electrode connected to the X-direction wire electrode.

Figure 6:
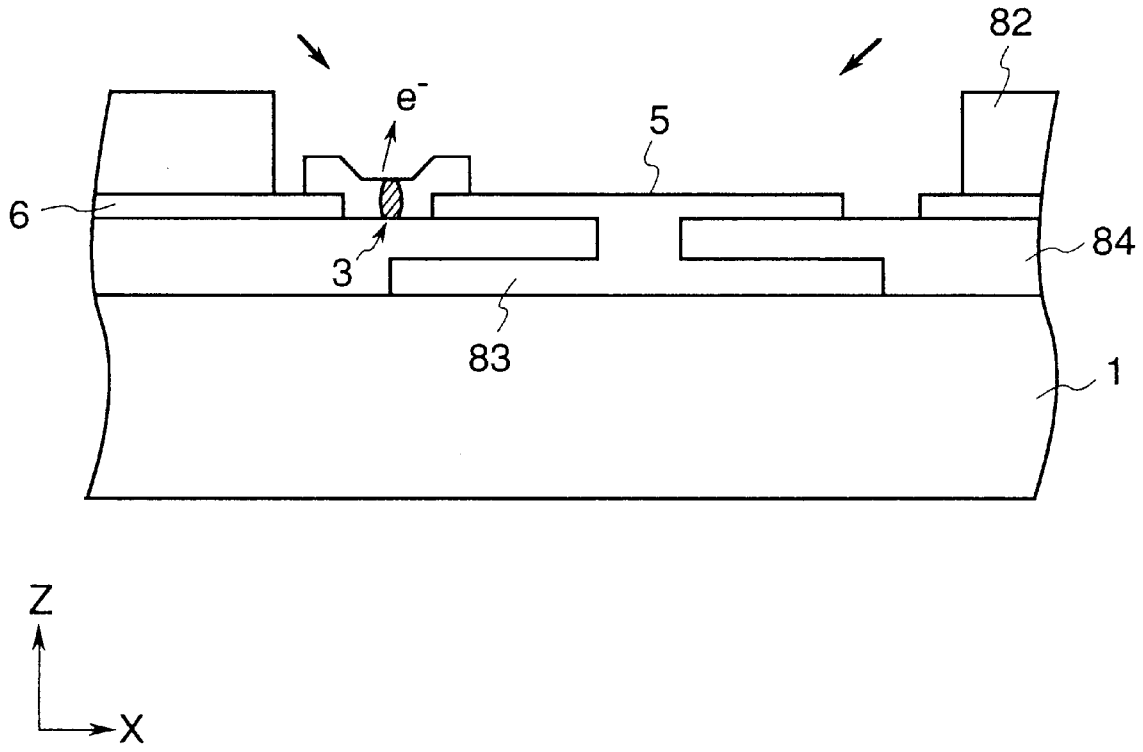
FIG. 6 is an enlarged sectional view of a portion near an electron-emitting region for explaining the principle of the present invention.

The reason why the electron beam generated is converged with the present element having the above features will now be described with reference to FIG. 6. FIG. 6 is a sectional view taken along line A - A' in FIG. 1, the view showing one electron-emitting element and the vicinity thereof.

With the electrode arrangement and the voltage applying conditions according to the present invention as described above, in FIG. 6, the element electrode 5 connected to the Y-direction wire electrode becomes always a higher-potential electrode due to the differential voltage, while the X-direction wire electrode 82 and the element electrode 6 connected to the X-direction wire electrode 82 become always lower-potential electrodes. Therefore, an electric field is produced in the vicinity of the electron-emitting region 3 as indicated by arrows in FIG. 6 so that electrons emitted from the region 3 and tending to diverge is subjected to forces acting to face each other on both sides in the X-direction and hence are converged. As a result, the spot size on the fluorescent substance is reduced.

While the above description is made of the X-direction only, the converging action is similarly produced in the Y-direction because the electron-emitting region 3 is surrounded by the X-direction wire electrode 82 held at a relatively negative potential in the Y-direction as well.

Although the magnitude of the converging action depends on such parameters as the size of and the distance between the electrodes, the applied voltage and the accelerating voltage, one example is as follows. The spot size in the X-direction resulted when applying 5 kV at a position 3 mm above the above-described comparative sample was 300 $\mu$m. On the other hand, the electron-emitting region was formed in one end of an X-direction electrode being 100 $\mu$m wide, and a pair of electrodes being each 1 mm wide were formed on both sides of the electron-emitting region in sandwiched relation thereto. Then, the spot size was similarly measured by applying 14 V to the central electrode being 100 $\mu$m and 0 V to the outer electrodes. The resultant spot size in the X-direction was about 240 $\mu$m, and the effect of reducing the spot size was about 20%.

The foregoing arrangement has been described as being just required to manufacture one preferred image display device for use in displaying an image. Details of such as materials of the device parts, for example, are not limited to the above ones, but may be selected to be suitable for uses of the image display device as desired.

Further, according to the concept of the present invention, the above image display device is not only suitable for displaying an image, but also applicable to an optical printer, which comprises a photosensitive drum, light-emitting diodes and so on, as a light-emitting source instead of the light-emitting diodes. In this case, by properly selecting the m lines of row wire and the n lines of column wire, the image display device can be employed as a two-dimensional light-emitting source rather than being simply used as a linear light-emitting source.

Example 2

This Example represents the case that a number of vertical type surface conduction electron-emitting elements are formed on a substrate, an interlayer insulating layer between X-direction wire and Y-direction wire serves also as step-forming sections of the surface conduction electron-emitting elements, and element electrodes are the same in constituent elements or its entirety as connecting electrodes to the X-direction wire and the Y-direction wire.

Figure 7:
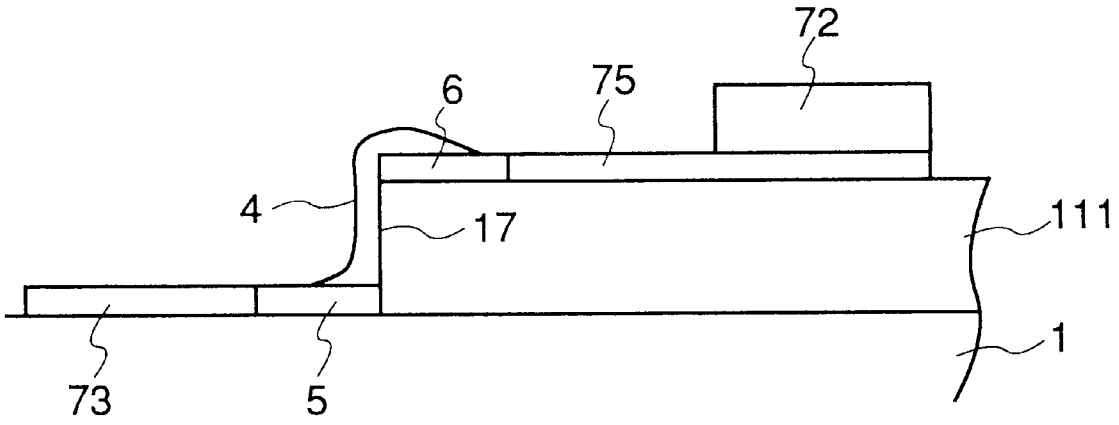
FIG. 7 is a sectional view of a vertical type surface conduction electron-emitting element according to a second embodiment of the present invention.
Figure 8A:
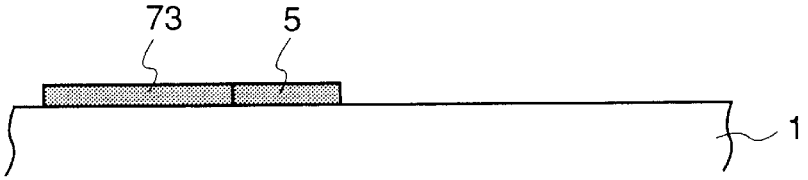
FIGS. 8A to 8F are sectional views showing successive steps of a process of manufacturing the vertical type surface conduction electron-emitting element according to the second embodiment of the present invention.
Figure 8B:
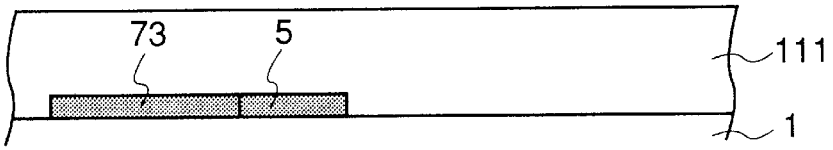
Figure 8C:
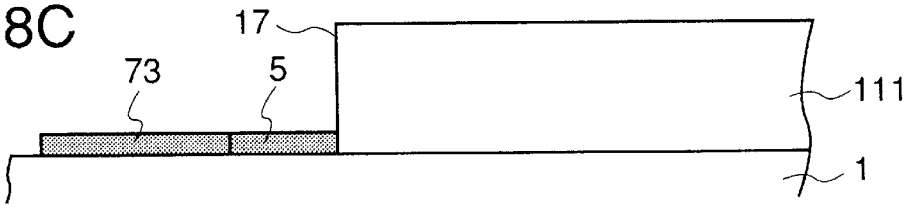
Figure 8D:
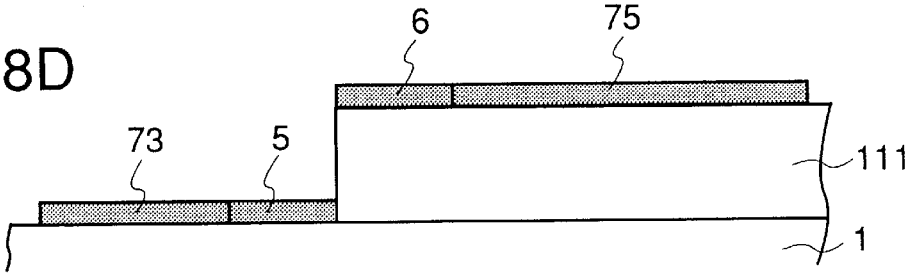
Figure 8E:
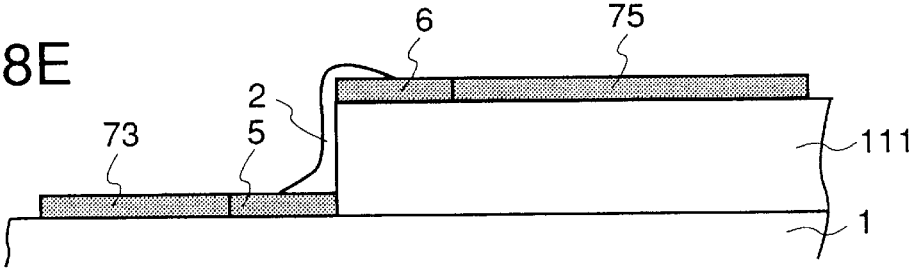
Figure 8F:
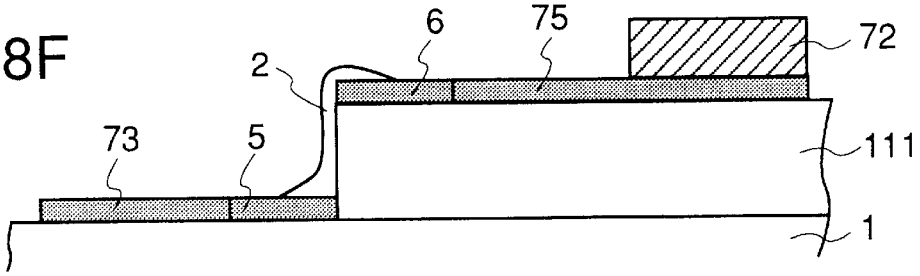

A partial perspective view of the electron source of this Example is basically similar to FIG. 1 and hence omitted here. A sectional view corresponding to FIG. 2, i.e., taken along line A - A' in FIG. 1, but illustrating the electron source of this Example is shown in FIG. 7. In FIG. 7, the same reference numerals as those in FIG. 2 denote the same components. Denoted by 1 is a substrate, 72 is an X-direction wire (also called an upper lead) corresponding to DXn in FIG. 18, 73 is a Y-direction wire (also called a lower lead) corresponding to DYn in FIG. 18, 4 is an electron-emitting region including thin film, 5 and 6 are element electrodes, and 111 is an interlayer insulating layer.

The manufacture process will now be described in detail in the order of successive steps with reference to FIGS. 8A to 8F.

Step-a

The substrate 1 made of soda lime glass was washed, and a Pd film being 5000 A thick was laminated on the substrate 1 by vacuum evaporation. A photoresist (AZ1370, by Hoechst Co.) was coated thereon under rotation by using a spinner and then baked. Thereafter, by exposing and developing a photomask image, a resist pattern for the Y-direction wire 73 was formed. The deposited Pd film was selectively removed by etching to thereby form the Y-direction wire 73 and the element electrodes 5 in the desired pattern.

Step-b

Then, a silicon oxide film being 1.5 microns thick and becoming the interlayer insulating layers 111 between the X-direction wire 72 and the Y-direction wire 73, the layers 111 doubling as step-forming sections 17 of the vertical type surface conduction electron-emitting elements, was deposited over the entire substrate by RF sputtering.

Step-c

A photoresist pattern for forming the step-forming sections 17 and hence the interlayer insulating layers 111 was coated in the desired pattern on the silicon oxide film deposited in Step-b and, by using it as a mask, the silicon oxide film was selectively etched to form the step-forming sections 17 and hence the interlayer insulating layers 111 in the desired pattern. The etching was carried out by the RIE (Reactive Ion Etching) process using a gas mixture of $CF_4$ and $H_2$.

Step-d

Thereafter, a photoresist (RD-2000N-41, by Hitachi Chemical Co., Ltd.) was coated in a pattern for forming the element electrodes 6 and the connecting electrodes 75. A Pd film being 1000 A thick was then deposited thereon by vacuum evaporation. The photoresist pattern was dissolved by an organic solvent to leave the deposited Pd film by liftoff, whereby the element electrodes 6 opposite to the element electrodes 5 and each having the width W1 of 500 microns were formed along with the connecting electrodes 75. The distance L1 between the element electrodes corresponding to the step-forming section 17 was 1.5 microns.

Step-e

As with above Example 1, a Cr film being 1000 A thick was deposited by vacuum evaporation and patterned into a shape corresponding to the electron-emitting region forming thin film 2 with the aid of a mask which has an opening covering the element electrodes 5, 6 and the vicinity thereof. An organic Pd solution (ccp4230, by Okuno Pharmaceutical Co., Ltd.) was coated thereon under rotation by using a spinner and then heated for baking at 300° C. for 10 minutes. The electron-emitting region forming thin film 2 thus formed and comprising fine particles of Pd as a primary constituent element had a thickness of 150 angstroms and a sheet resistance value of $7\times10^4$ ohms/□.

After that, the Cr film and the electron-emitting region forming thin film 2 after the baking were wet-etched by an acid etchant to be formed into the desired pattern.

Step-f

An Ag-Pd conductor film being about 10 microns thick was printed on the element electrode 6 to form the X-direction wire 72 in the desired pattern.

As a result of the above steps, the X-direction wire 72, the interlayer insulating layers 111, the Y-direction wire 73, the element electrodes 5, 6, the electron-emitting region forming thin films 2, etc. were formed on the insulating substrate 1.

Next, an image display device similar to that shown in FIG. 5 was constructed by using the electron source thus manufactured, as with Example 1.

As a result of applying the element voltage between the element electrodes 5 and 6 of a comparative sample and measuring the element current If and the emission current Ie which flowed under that condition, the current - voltage characteristic similar to that shown in FIG. 16 was also obtained. In the comparative sample, the emission current Ie started increasing abruptly when the element voltage reached about 7.5 V. At the element voltage of 14 V, the element current If was 2.5 mA, the emission current Ie was 1.2 $\mu$A, and the electron emission efficiency $\eta$=Ie/If (%) was 0.048%.

In the completed image display device of this Example, similarly to Example 1, a scanning signal and a modulation signal were applied from a signal generating means (not shown) to the electron-emitting elements via terminals Dx1 to Dxm and Dy1 to Dyn outside the envelope such that the voltage of the modulation signal side was always higher than or equal to the voltage of the scan signal, causing the electron-emitting elements to emit electrons. A high voltage more than several kV was applied to a metal back 94 or a transparent electrode (not shown) via a high-voltage terminal Hv for accelerating electron beams to impinge against a fluorescent film 93 so that the fluorescent substance was excited to radiate light to thereby display an image. As a result, since the respective electrodes are arranged such that, as seen from FIGS. 8A to 8F, each electron-emitting region 3 was surrounded by the X-direction wire electrode 72 and the connecting electrode connected thereto, i.e., by the electrodes on the lower-potential side, the electron beam was converged as with Example 1. Additionally, in this Example, since the electron-emitting regions were formed in the interlayer insulating layer between the X- and Y-direction wires, the electron source could be manufactured with a higher density of the electron-emitting elements.

Example 3

Figure 9:
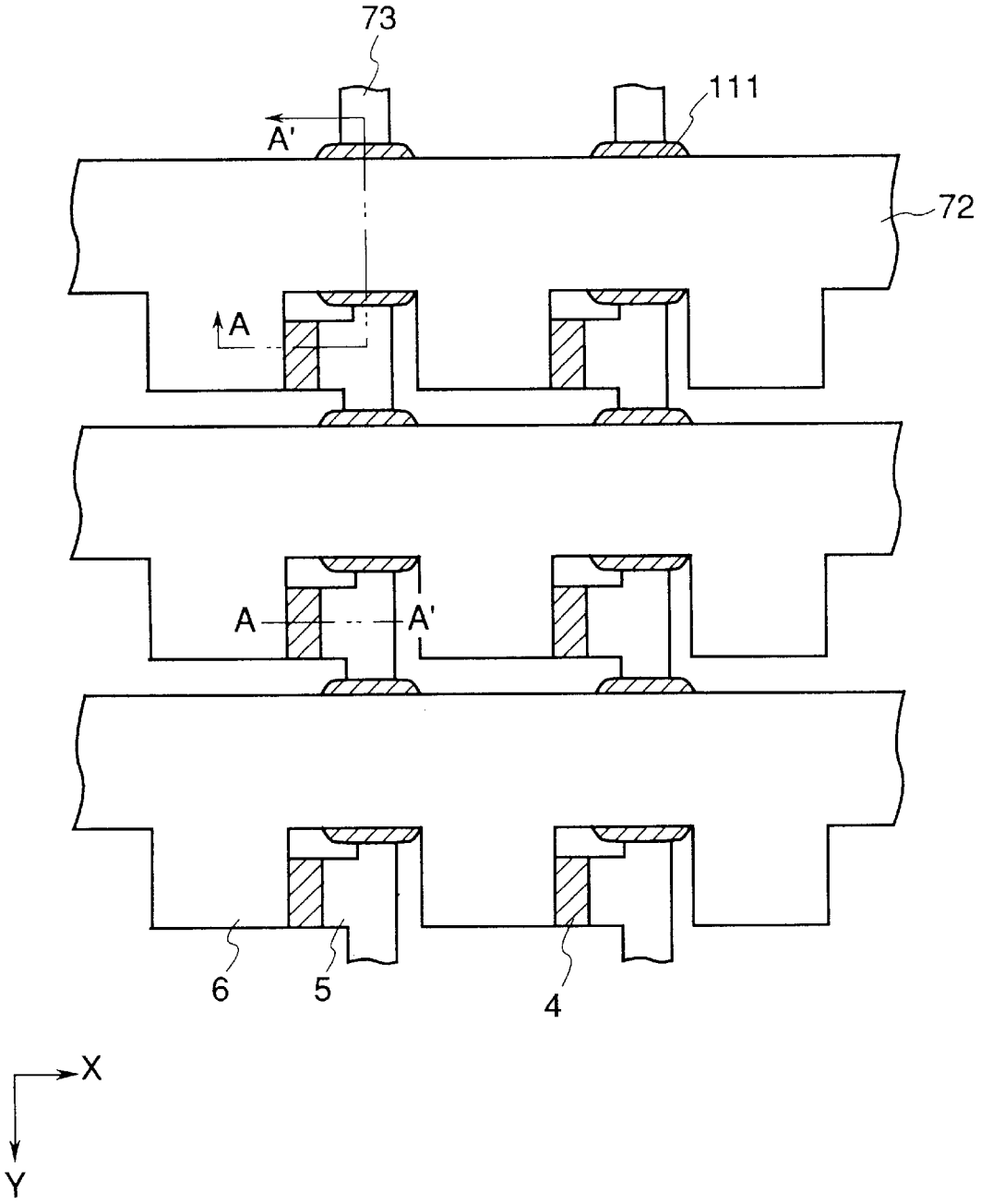
FIG. 9 is a plan view of an electron source according to a third embodiment of the present invention.
Figure 10:
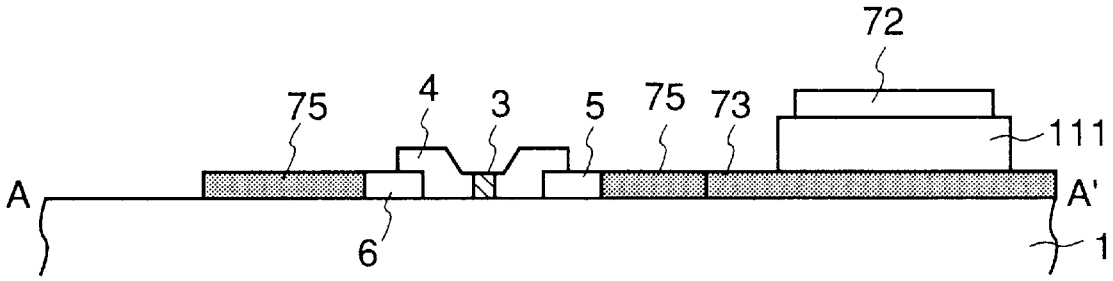
FIG. 10 is a partial enlarged sectional view of the electron source according to the third embodiment of the present invention.
Figure 11A:
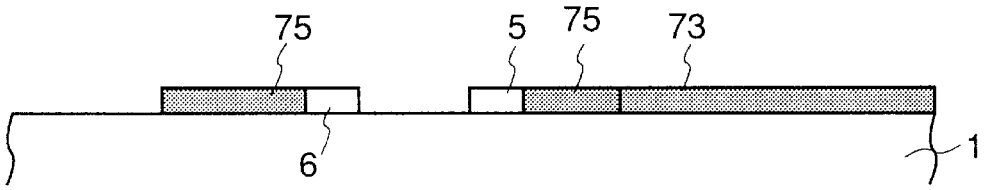
FIGS. 11A to 11E are sectional views showing successive steps of a process of manufacturing the electron source according to the second embodiment of the present invention.
Figure 11B:
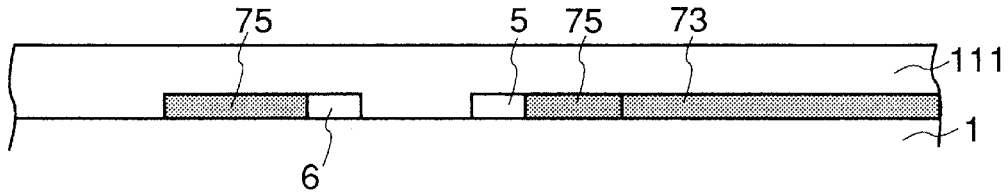
Figure 11C:
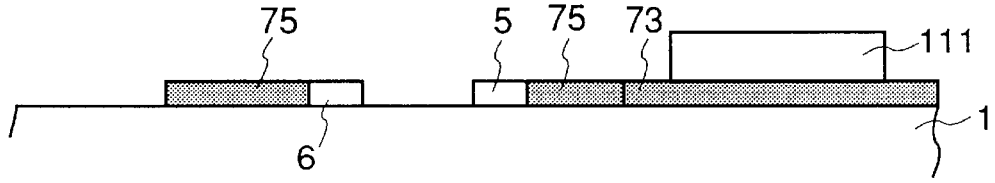
Figure 11D:
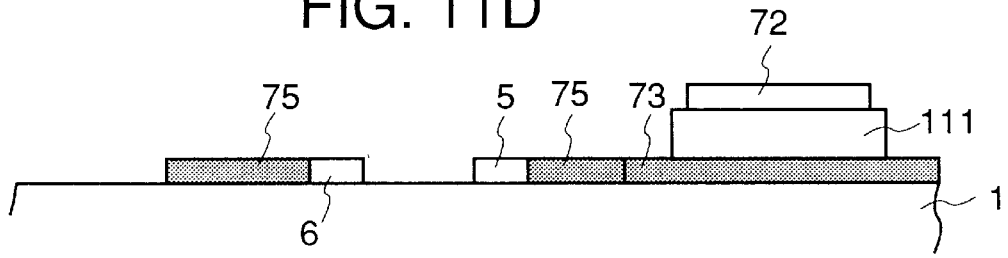
Figure 11E:
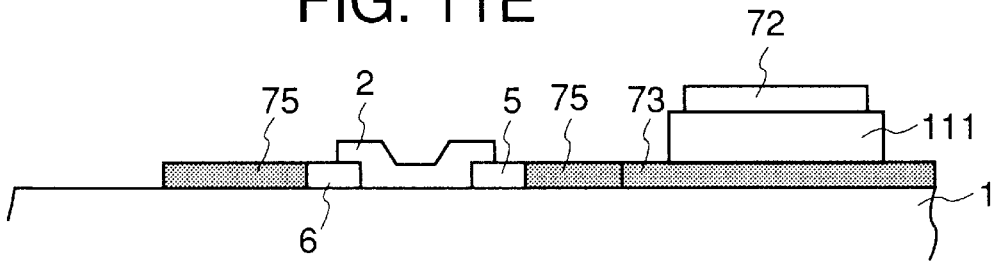

This Example represents the case that a number of planar type surface conduction electron-emitting elements are formed on a substrate, an interlayer insulating layer between X-direction wire and Y-direction wire exists only in crossing portions of the X- and Y-direction wires, and element electrodes and connecting electrodes to the X-direction wire and the Y-direction wire are electrically connected to each other without contact holes and are all disposed directly on the insulating substrate. A partial plan view of the electron source of this Example is shown in FIG. 9. A sectional view taken along line A - A' in FIG. 9 is shown in FIG. 10. In FIGS. 9 and 10, the same reference numerals denote the same components. Denoted by 1 is a substrate, 72 is an X-direction wire (also called an upper wire) corresponding to DXn in FIG. 18, 73 is a Y-direction wire (also called a lower wire) corresponding to DYn in FIG. 18, 4 is an electron-emitting region including thin film, 5 and 6 are element electrodes, and 111 is an interlayer insulating layer.

The manufacture process will now be described in detail in the order of successive steps with reference to FIGS. 11A to 11E.

Step-a

The substrate 1 made of soda lime glass was washed, and a Cr film being 50 A thick and an Au film being 1000 A thick were laminated on the substrate 1 by vacuum evaporation. A photoresist (AZ1370, by Hoechst Co.) was coated thereon under rotation by using a spinner and then baked. Thereafter, by exposing and developing a photomask image, a resist pattern for the element electrode 5, 6, the connecting electrodes 75 and the Y-direction wire 73 were formed. The deposited A/Cr films were selectively removed by etching to thereby form the Y-direction wire 73, the element electrodes 5, 6 (W=300 μm, L1=2 μm) and the connecting electrodes 75 in the desired patterns.

Step-b

Then, a silicon oxide film being 1.0 micron thick and becoming the interlayer insulating layers 111 between the X-direction wire 72 and the Y-direction wire 73 was deposited over the entire substrate by RF sputtering.

Step-c

A photoresist pattern for forming the interlayer insulating layers 111 in only crossing portions of the X-direction wire 72 and the Y-direction wire 73 was coated in the desired pattern on the silicon oxide film deposited in Step-b and, by using it as a mask, the silicon oxide film was selectively etched to form the interlayer insulating layers 111. The etching was carried out by the RIE (Reactive Ion Etching) process using a gas mixture of $CF_4$ and $H_2$.

Step-d

Thereafter, a photoresist (RD-2000N-41, by Hitachi Chemical Co., Ltd.) was coated in a pattern for forming the X-direction wire 72, and an Au film being 5000 A thick was then deposited thereon by vacuum evaporation. The photoresist pattern was dissolved by an organic solvent to leave the deposited Au film by liftoff, whereby the X-direction wire 72 were formed.

Step-e

As with above Example 1, a Cr film being 1000 A thick was deposited by vacuum evaporation and patterned into a shape corresponding to the electron-emitting region forming thin film 2 with the aid of a mask which has an opening covering the element electrodes 5, 6 and the vicinity thereof. An organic Pd solution (ccp4230, by Okuno Pharmaceutical Co., Ltd.) was coated thereon under rotation by using a spinner and then heated for baking at 300° C. for 10 minutes. The electron-emitting region forming thin film 2 thus formed and comprising fine particles of Pd as a primary constituent element had a thickness of 75 angstroms and a sheet resistance value of $1\times10^5$ ohms/□.

After that, the Cr film and the electron-emitting region forming thin film 2 after the baking were wet-etched by an acid etchant to be formed into the desired pattern.

As a result of the above steps, the X-direction wire 72, the interlayer insulating layers 111, the Y-direction wire 73, the element electrodes 5, 6, the electron-emitting region forming thin films 2, etc. were formed on the insulating substrate 1.

Figure 28:
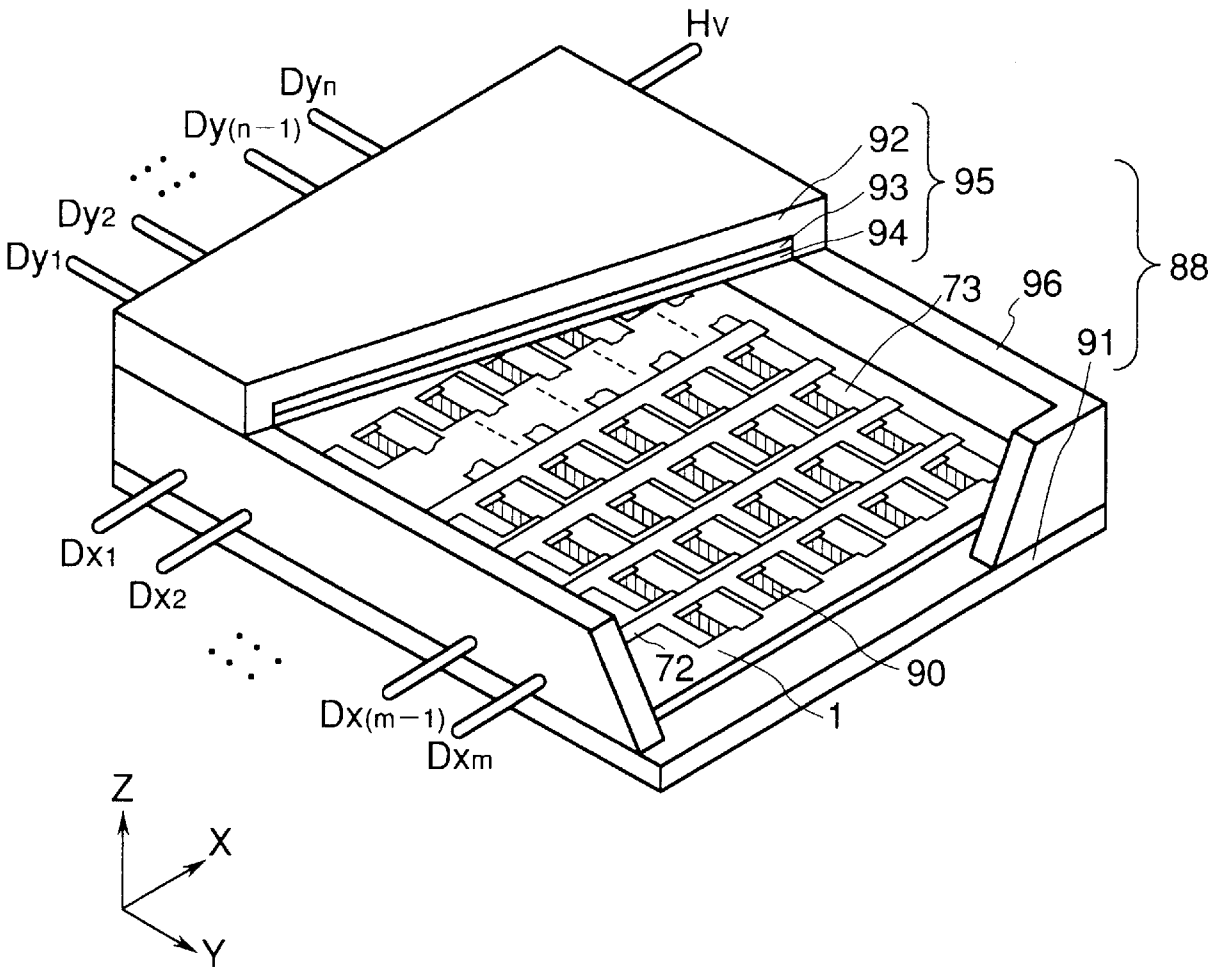
FIG. 28 is a perspective view of an image display device using the electron source according to the third embodiment of the present invention.

Next, an image display device similar to that shown in FIG. 28 was constructed by using the electron source thus manufactured, as with Example 1.

For each of the electron-emitting elements of this Example manufactured above, the current - voltage characteristic similar to that shown in FIG. 16 was also obtained.

In the element of this Example, the emission current Ie started increasing abruptly when the element voltage reached about 7.0 V. At the element voltage of 14 V, the element current If was 2.1 mA, the emission current Ie was 1.0 μA, and the electron emission efficiency η=Ie/If (%) was 0.05%. (A target electrode was placed 5 mm above the substrate on which the elements were manufactured, and a voltage of 1 kV was applied).

In the arrangement of this Example, a scan signal and an information signal were applied to X- and Y-direction wire electrodes, respectively such that the voltage of the modulation signal was always higher than or equal to the voltage of the scanning signal. Also, as shown in FIG. 9, the electrode arrangement was selected such that even when each electron-emitting region could not be surrounded by one X-direction wire electrode only, it was surrounded in at least three directions by the connecting electrode or the element electrode of the adjacent element connected to the X-direction wire electrode in addition to the X-direction wire electrode. As a result, each electron-emitting region was surrounded by the electrodes on the lower-potential side, and hence the electron beam was converged as with Examples 1 and 2.

According to the present invention, as described hereinabove, an electron source comprises a number of surface conduction electron-emitting elements which are arrayed on an insulating substrate into a matrix pattern and have each a pair of element electrode positioned in opposite relation with an electron-emitting region including thin film therebetween and connected to corresponding ones of m lines of row wire electrodes and n lines column wire electrodes, both these electrodes being formed to cross each other with an insulating layer interposed therebetween. Then, in such as electron source, the voltage applied to the column wire electrodes is set to be always higher than or equal to the voltage applied to the row wire electrodes, and an electron-emitting region of each element is surrounded in at least three directions, when viewed as from above the substrate, by at least one of the row wire electrode, a connecting electrode for connecting the row wire electrode and the element electrode, and the element electrode, connected to the row wire electrode. As a result, an electron beam emitted from each element can be converged with the simple structure in combination of the element electrode, the wire electrode and the connecting electrode, making it possible to provide a higher density in array of the electron-emitting elements and an image with higher precision.

What is claimed is:

1. An electron source comprising:

a substrate, a first wire and a second wire laminated on said substrate to cross each other with an insulating layer interposed therebetween, and an electron-emitting element, having an electron-emitting region, connected to both said first and second wires, wherein said electron-emitting element, said first wire and said second wire are each provided in plurality, with said plurality of electron-emitting elements arrayed into a matrix pattern and each said electron-emitting region surrounded by one of said first wires which is disposed over said insulating layer, and wherein the magnitude of a potential applied to said first wire disposed over said insulating layer is not greater than that of a potential applied to said second wire which is disposed under said insulating layer, with the potential applied to said first wire disposed over said insulating layer corresponding to a scanning signal and the potential applied to said second wire disposed under said insulating layer corresponding to a modulation signal.

2. An electron source according to claim 1, wherein said insulating layer is disposed at least in the crossing portion of said first wires and said second wires.

3. An electron source according to claim 1, wherein said electron-emitting elements are disposed on said insulating layer.

4. An electron source according to claim 1, wherein said electron-emitting elements are surface conduction electron-emitting elements.

5. An electron source according to claim 1, wherein said electron-emitting elements are electron-emitting elements each having, between electrodes, a conductive film including said electron-emitting region.

6. An electron source according to claim 5, wherein said conductive film including said electron-emitting region is made up of fine particles.

7. An electron source according to claim 5, wherein said conductive film including said electron-emitting region is made up of fine particles containing Pd as a main constituent element.

8. An electron source according to claim 1, wherein each said electron-emitting region is surrounded by one of said first wires which is disposed over said insulating layer in at least three of four directions orthogonal to each other in a plane in which said electron-emitting elements are disposed.

9. An image-forming apparatus comprising:

an electron source emitting an electron beam, and an image-forming member for forming an image upon irradiation of the electron beam emitted from said electron source in accordance with an input signal, said electron source comprising;

a substrate, a first wire and a second wire laminated on said substrate to cross each other with an insulating layer interposed therebetween, and an electron-emitting element, having an electron-emitting region, connected to both said first and second wires, wherein said electron source is arranged such that said electron-emitting element, said first wire and said second wire are each provided in plurality, with said plurality of electron-emitting elements arrayed into a matrix pattern and each said electron-emitting region surrounded by one of said first wires which is disposed over said insulating layer, and wherein the magnitude of a potential applied to said first wire disposed over said insulating layer is not greater than that of a potential applied to said second wire which is disposed under said insulating layer, with the potential applied to said first wire disposed over said insulating layer corresponding to a scanning signal and the potential applied to said second wire disposed under said insulating layer corresponding to a modulation signal.

10. An image-forming apparatus according to claim 9, wherein said electron source is arranged such that said electron-emitting elements are disposed on said insulating layer.

11. An image-forming apparatus according to claim 10, wherein said input signal is selected from a TV signal, a signal from an image input unit, a signal from an image memory or a signal from a computer.

12. An image-forming apparatus according to claim 9, wherein said electron source is arranged such that said electron-emitting elements are surface conduction electron-emitting elements.

13. An image-forming apparatus according to claim 12, wherein said input signal is selected from a TV signal, a signal from an image input unit, a signal from an image memory or a signal from a computer.

14. An image-forming apparatus according to claim 9, wherein said electron source is arranged such that said electron-emitting elements are electron-emitting elements each having, between electrodes, a conductive film including the electron-emitting region.

15. An image-forming apparatus according to claim 14, wherein said input signal is selected from a TV signal, a signal from an image input unit, a signal from an image memory or a signal from a computer.

16. An image-forming apparatus according to claim 14, wherein said electron source is arranged such that said conductive film including said electron-emitting region is made up of fine particles.

17. An image-forming apparatus according to claim 16, wherein said input signal is selected from a TV signal, a signal from an image input unit, a signal from an image memory or a signal from a computer.

18. An image-forming apparatus according to claim 14, wherein said electron source is arranged such that said conductive film including said electron-emitting region is made up of fine particles containing Pd as a main constituent element.

19. An image-forming apparatus according to claim 18, wherein said input signal is selected from a TV signal, a signal from an image input unit, a signal from an image memory or a signal from a computer.

20. An image-forming apparatus according to claim 9, wherein said electron source is arranged such that each said electron-emitting region is surrounded by one of said first wires which is disposed over said insulating layer in at least three of four directions orthogonal to each other in a plane in which said electron-emitting elements are disposed.

21. An image-forming apparatus according to claim 20, wherein said input signal is selected from a TV signal, a signal from an image input unit, a signal from an image memory or a signal from a computer.

22. An image-forming apparatus according to claim 9, wherein said electron source is arranged such that said insulating layer is disposed at least in the crossing portion of said first wires and said second wires.

23. An image-forming apparatus according to claim 22, wherein said input signal is selected from a TV signal, a signal from an image input unit, a signal from an image memory or a signal from a computer.

24. An image-forming apparatus according to claim 9, wherein said input signal is selected from a TV signal, a signal from an image input unit, a signal from an image memory or a signal from a computer.

25. An electron source comprising:

a substrate;

a first wire and a second wire laminated on said substrate to cross each other with an insulating layer interposed therebetween; and an electron-emitting element, having an electron-emitting region, connected to both said first and second wires, wherein said electron-emitting element, said first wire and said second wire are each provided in plurality, with said plurality of electron-emitting elements arrayed into a matrix pattern and each electron-emitting region surrounded by one of said first wires and electrodes for connecting said one first wire and the electron-emitting region, with said one first wire disposed over said insulating layer, and wherein the magnitude of a potential applied to said first wire disposed over said insulating layer is not greater than that of a potential applied to said second wire which is disposed under said insulating layer, with the potential applied to said first wire disposed over said insulating layer corresponding to a scanning signal and the potential applied to said second wire disposed under said insulating layer corresponding to a modulation signal.

26. An electron source according to claim 25, wherein each said electron-emitting region is surrounded in at least three of four directions orthogonal to each other in a plane in which said electron-emitting elements are disposed by one of said first wires and an electrode for connecting said one first wire and the electron-emitting region, with said one first wire disposed over said insulating layer.

27. An electron source according to claim 25, wherein said insulating layer is disposed at least in the crossing portion of said first wire and said second wire.

28. An electron source according to claim 25, wherein said electron-emitting elements are disposed on said insulating layer.

29. An electron source according to claim 25, wherein said electron-emitting elements are surface conduction electron-emitting elements.

30. An electron source according to claim 25, wherein said electron-emitting elements each have, between element electrodes, a conductive film including the electron-emitting region.

31. An electron source according to claim 30, wherein said conductive film including the electron-emitting region is made up of fine particles.

32. An electron source according to claim 30, wherein said conductive film including the electron-emitting region is made up of fine particles containing Pd as a main constituent element.

33. An image-forming apparatus comprising:

an electron source emitting an electron beam;

an image-forming member for forming an image upon irradiation of the electron beam emitted from said electron source in accordance with an input signal, wherein said electron source comprises:

a substrate;

a first wire and a second wire laminated on said substrate to cross each other with an insulating layer interposed therebetween; and an electron-emitting element, having an electron-emitting region, connected to both said first and second wires, wherein said electron-emitting element, said first wire and said second wire are each provided in plurality, with said plurality of electron-emitting elements arrayed into a matrix pattern and each electron-emitting region surrounded by one of said first wires and electrodes for connecting said one first wire and the electron-emitting region, said one first wire disposed over said insulating layer, and wherein the magnitude of a potential applied to said first wire disposed over said insulating layer is not greater than that of a potential applied to said second wire which is disposed under said insulating layer, with the potential applied to said first wire disposed over said insulating layer corresponding to a scanning signal and the potential applied to said second wire disposed under said insulating layer corresponding to a modulation signal.

34. An image-forming apparatus according to claim 33, wherein each said electron-emitting region is surrounded in at least three of four directions orthogonal to each other in a plane in which said electron-emitting elements are disposed, by one of said first wires and an electrode for connecting said one first wire and the electron-emitting region, with said one first wire disposed over said insulating layer.

35. An image-forming apparatus according to claim 33, wherein said insulating layer is disposed at least in the crossing portion of said first wire and said second wire.

36. An image-forming apparatus according to claim 33, wherein said electron-emitting elements are disposed on said insulating layer.

37. An image-forming apparatus according to claim 33, wherein said electron-emitting element are surface conduction electron-emitting elements.

38. An image-forming apparatus according to claim 33, wherein said input signal is selected from a TV signal, a signal from an image input unit, a signal from an image memory or a signal from a computer.

39. An image-forming apparatus according to claim 33, wherein said electron-emitting elements each have, between element electrodes, a conductive film including the electron-emitting region.

40. An image-forming apparatus according to claim 39, wherein said conductive film including the electron-emitting region is made up of fine particles.

41. An image-forming apparatus according to claim 39, wherein said conductive film including the electron-emitting region is made up of fine particles containing Pd as a main constituent element.

42. An electron source comprising:

a substrate, a first wire and a second wire laminated on said substrate to cross each other with an insulating layer interposed therebetween, said first wire being disposed over said insulating layer and said second wire being disposed under said insulating layer, and an electron-emitting element, having an electron-emitting region, connected to both said first and second wires, wherein said electron-emitting element, said first wire and said second wire are each provided in plurality, with said plurality of electron-emitting elements arrayed into a matrix pattern, wherein a top surface of said first wire is at a higher level than that of said electron-emitting region, and wherein the magnitude of a potential applied to said first wire is not greater than that of a potential applied to said second wire, with the potential applied to said first wire corresponding to a scanning signal and the potential applied to said second wire corresponding to a modulation signal.

43. An image-forming apparatus comprising:

an electron source emitting an electron beam, and an image-forming member for forming an image upon irradiation of the electron beam emitted from said electron source in accordance with an input signal, said electron source comprising:

a substrate, a first wire and a second wire laminated on said substrate to cross each other with an insulating layer interposed therebetween, said first wire being disposed over said insulating layer and said second wire being disposed under said insulating layer, and an electron-emitting element, having an electron-emitting region, connected to both said first and second wires, wherein said electron-emitting element, said first wire and said second wire are each provided in plurality, with said plurality of electron-emitting elements arrayed into a matrix pattern, wherein a top surface of said first wire is at a higher level than that of said electron-emitting region, and wherein the magnitude of a potential applied to said first wire is not greater than that of a potential applied to said second wire, with the potential applied to said first wire corresponding to a scanning signal and the potential applied to said second wire corresponding to a modulation signal.

* * * * *

UNITED STATES PATENT AND TRADEMARK OFFICE

CERTIFICATE OF CORRECTION

PATENT NO. : 5,932,963
DATED : August 3, 1999
INVENTOR(S) : Naoto Nakamura et al.

It is certified that error appears in the above-identified patent and that said Letters Patent is hereby corrected as shown below:

Title page,
Item [22] Filed: "Oct. 31, 1996" should read -- Nov. 1, 1996 --.

Column 1,
Line 31, "molybednum" should read -- molybdenum --.

Column 7,
Line 6, "$In_2O_3$-$SnO_2O$" should read -- $In_2O_3$-$SnO_2$, --.

Signed and Sealed this

Nineteenth Day of March, 2002

*Attest:*

*Attesting Officer*

JAMES E. ROGAN
*Director of the United States Patent and Trademark Office*